US006372064B1

(12) United States Patent
Butterworth et al.

(10) Patent No.: US 6,372,064 B1
(45) Date of Patent: Apr. 16, 2002

(54) TAIL SEALER APPARATUS AND METHOD

(75) Inventors: Tad T. Butterworth, Ashland, WI (US); John W. LaChapelle, Jr., Ironwood, MI (US)

(73) Assignee: C. G. Bretting Manufacturing Company, Inc., Ashland, WI (US)

( * ) Notice: Subject to any disclaimer, the term of this patent is extended or adjusted under 35 U.S.C. 154(b) by 0 days.

(21) Appl. No.: 09/459,517

(22) Filed: Dec. 13, 1999

(51) Int. Cl.[7] ..... B32B 31/00; B65H 81/00

(52) U.S. Cl. ..... 156/64; 156/187; 156/357; 156/450; 156/578

(58) Field of Search ..... 156/64, 187, 357, 156/446, 448, 449, 450, 578, 152

(56) References Cited

U.S. PATENT DOCUMENTS

| | | | | |
|---|---|---|---|---|
| 2,357,476 A | | 9/1944 | Kaulen | |
| 2,573,188 A | | 10/1951 | Dyken | |
| 2,755,768 A | | 7/1956 | Olson | |
| 3,113,884 A | | 12/1963 | Kohler | |
| 3,393,105 A | | 7/1968 | Tellier, Jr. | |
| 3,415,221 A | | 12/1968 | Stenger | |
| 3,554,641 A | | 1/1971 | Jeffee et al. | |
| 3,789,794 A | | 2/1974 | Smith et al. | |
| 4,026,752 A | | 5/1977 | Hartbauer et al. | |
| 4,102,304 A | | 7/1978 | Debenham | |
| 4,299,642 A | * | 11/1981 | Berkholtz | 156/191 |
| 4,328,931 A | | 5/1982 | Gordon-Clark et al. | |
| 4,456,190 A | | 6/1984 | Karttunen et al. | |
| 4,475,974 A | | 10/1984 | Perini | |
| 4,581,083 A | * | 4/1986 | Schutz et al. | 156/64 |
| 4,586,645 A | | 5/1986 | Harada | |
| 4,609,421 A | | 9/1986 | Yui | |
| 4,693,766 A | * | 9/1987 | Stauffer | 156/64 |
| 4,695,482 A | | 9/1987 | Weiswurm | |
| 4,708,629 A | | 11/1987 | Kasamatsu | |
| 4,963,223 A | | 10/1990 | Biagotti | |
| 5,033,403 A | | 7/1991 | Mladota | |
| 5,242,525 A | | 9/1993 | Biagiotti | |
| 5,259,910 A | | 11/1993 | Biagiotti | |
| 5,267,703 A | | 12/1993 | Biagiotti | |

(List continued on next page.)

OTHER PUBLICATIONS

L. G. Eriksson, C. Lydig and J.A. Viglund, Measurement of Paper Roll Density During Winding, Tappi Journal, Jan. 1983, vol. 88, No. 1, Technical Assoc. of the Pulp and Fiber Industry, Inc., Atlanta, GA, USA.

*Primary Examiner*—Mark A. Osele
(74) *Attorney, Agent, or Firm*—Michael Best & Friedrich LLP

(57) ABSTRACT

An apparatus and method for sealing the tail of a rolled product against the rolled product using a roller and one or more sensors to position the tail for accurate adhesive application upon the tail and/or the log. After being positioned in a location upon a roller, the rolled product is rotated between the roller and a conveyor assembly until a jet blows the unsealed tail against the roller. By further rotating the roller, a sensor detects the location of the tail end, thereby establishing a reference (along with measured roller and conveyor assembly movements) for determining tail length in later operations. Next, the roller is reversed to pass the tail around the roller and preferably to a tail support adjacent to the roller. When the tail reaches a desired position along the tail support, an applicator sensor sends a signal to an adhesive assembly which applies adhesive to the tail and/or to the rolled product. Preferably, the adhesive assembly includes one or more adhesive sprayers triggered by the applicator sensor. After the adhesive has been applied, the roller is again reversed to roll the tail back upon the rolled product. The rewound rolled product is then preferably rolled over at least one ironing roller to ensure proper adhesion of the tail to the rolled product. For increased tail control in the various stages of operation, the roller can be a vacuum roller or be fitted with an electrostatic generator to hold the tail against the surface of the roller.

31 Claims, 15 Drawing Sheets

U.S. PATENT DOCUMENTS 5,474,646 A * 12/1995 Matteucci ..... 156/443
5,478,430 A 12/1995 Marchetti
5,573,615 A 11/1996 Vigneau et al.
5,643,398 A * 7/1997 Lumberg ..... 156/446
5,679,206 A * 10/1997 Glass ..... 156/446
RE35,729 E 2/1998 Biagiotti
5,716,489 A 2/1998 Biagiotti
5,800,652 A 9/1998 Vigneau et al.f

* cited by examiner

TAIL SEALER APPARATUS AND METHOD

FIELD OF THE INVENTION

The present invention relates to apparatus and methods for controlling and manipulating rolled products, and more particularly to apparatus and methods for manipulating the tail ends of rolls (or "logs") of sheet product and securing the tail ends in place on the logs.

BACKGROUND OF THE INVENTION

A common problem in the sheet rewinding industry arises during the final stages of the product's preparation. Specifically, when the sheet material (such as paper product) has been wound into a log, it is routinely necessary to secure the tail end of the rolled product against unwinding. Though there exists a number of well-known ways in which the tail end may be secured or "sealed" (e.g., by gluing, moistening, etc.), each requires some manipulation of the tail end for correct alignment in glue application, proper rewinding, etc. Preferably, the tail of a product log is laid flat and unwrinkled against the log, with the tail being secured to the log at a position a short distance from the very end of the tail. This tail sealing arrangement leaves a small length of the end of the tail unsecured to enable the end user to grasp, unseal, and unwind the rolled product. Improper tail end manipulation during the tail sealing process can lead to a number of undesirable results, including inconsistent tail end length and wrinkles in the sealed tail.

The foregoing and following discussion concerning the sheet rewinding industry is particularly relevant to paper rewinding. Accordingly, the problems and solutions described below are presented by way of illustration in the context of paper rewinding operations, such as rewinding operations on tissue paper, toilet paper, paper toweling, and the like. However, the present invention is not limited to paper rewinding or even to the paper industry. The present invention finds applicability in any or operation in which rolled material is manipulated and/or wound. As such, reference in the present application and appended claims to "logs" of material include rolled product made of any material, such as paper, plastic, rubber, metal, composites, fabric, and the like. Also, the rolled product referred to herein and in the appended claims as product in "sheet" form can be of any shape and size, including material in sheet, strip, laminate, multi-ply or other form.

A number of conventional tail sealer methods and systems exist in the art. Several of these methods and systems are designed to avoid the aforementioned undesirable results of improper tail manipulation while maintaining a high rate of product output (i.e., sealed logs per minute). However, conventional tail sealers are usually quite complex, employing expensive systems and subsystems to separate and orient a measured length of the tail of each roll in a precise manner, apply adhesive to the tail or log in a precise location, and seal the tail on the log without wrinkling. Four examples of such conventional tail sealers are disclosed in U.S. Pat. No. 5,242,525 issued to Biagiotti, U.S. Pat. No. 4,475,974 issued to Perini, U.S. Pat. No. 3,393,105 issued to C. W. Teller, Jr., and U.S. Pat. No. 5,716,489 issued to Biagiotti. The teachings of the above-listed patents are incorporated herein by reference insofar as they relate to mechanisms and assemblies for manipulating tails of product rolls or logs. Due to their complexity, such conventional systems are invariably expensive and difficult to maintain. Also, an important limitation common to virtually all conventional systems is the maximum speed at which the systems can operate. In modem systems where a fraction of a second in each rewinding operation can significantly impact output and productivity, conventional tail sealing systems typically operate adequately at low speeds but display considerable inefficiencies when run to their highest speeds. The above-mentioned system complexity and bottlenecks caused thereby are often the cause of these inefficiencies. Additionally, such systems are generally less than precise and reliable in their sealing operations, particularly when run at higher speeds.

In light of the problems and limitations of the prior art described above, a need exists for a tail sealer apparatus and method which can reliably seal rolled products at a high rate, produce a consistent and controllable length of tails sealed to the logs, generate sealed tails which have few to no wrinkles, and do so by employing a simplified system design which lowers system and maintenance cost. Each embodiment of the present invention achieves one of more of these results.

SUMMARY OF THE INVENTION

The present invention is a system and method for sealing the tails of rolled products to their respective logs. To quickly accomplish this task while maintaining sufficient control of the tails during tail sealing, preferred embodiments of the present invention can include a rotary indexer assembly for controllably feeding rolled products into the tail sealer system, an upper conveyor assembly which rolls the rolled products through the tail sealer system, a lower conveyor assembly which rolls each rolled product within the tail sealer system to unroll the tail to a glue applying position and indexes the proper tail length of each rolled product, an adhesive assembly for applying adhesive to each tail and/or to each rolled product, and an ironing roller assembly which ensures contact between the tail and the rolled product for permitting the adhesive to bond the tail to the rolled product.

In accordance with a preferred method of the present invention, a product roll (or "log") is indexed into the tail sealer system by the indexer assembly. After being indexed, the log is held and preferably rotated in place between the lower conveyor assembly and the upper conveyor assembly. A roll in the lower conveyor assembly is preferably provided to rotate the log in this manner as one or more air jets blow the tail against the roll. In doing so, the length of the tail is measured by at least one sensor while the roll is precisely indexed. When the desired tail length is detected, one or more sprayers spray adhesive upon the unrolled tail and/or upon the log itself. The lower conveyor assembly and the upper conveyor assembly then preferably reverse directions to wind the tail back upon the log. Preferably, the surface speeds of the lower and upper conveyor assemblies are matched during this rewinding operation to keep the roll in place between the lower and upper conveyor assemblies until the tail is fully rewound upon the log. Alternatively, the speeds can be selected to move the log to a roll surface while the tail is being rewound. By gradually being rewound on the log as the log is rotated, the tail of the log is quickly rewound and sealed without wrinkles. The sealed log is then rolled to the ironing roller assembly for sealing the tail to the log and is finally ejected from the tail sealer system. Preferably, the orientation of the sealed log (the position of the sealed tail upon the log) is known and/or controllable to eject each sealed log from the tail sealer system in a uniform orientation. The orientation of the sealed log is preferably controlled by adjusting the speed and/or the number of rotations of the roller assembly, the conveyor assembly or both assemblies.

More information and a better understanding of the present invention may be achieved by reference to the following drawings and detailed description.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF PREFERRED EMBODIMENTS

The First Preferred Embodiment

Figure 1:
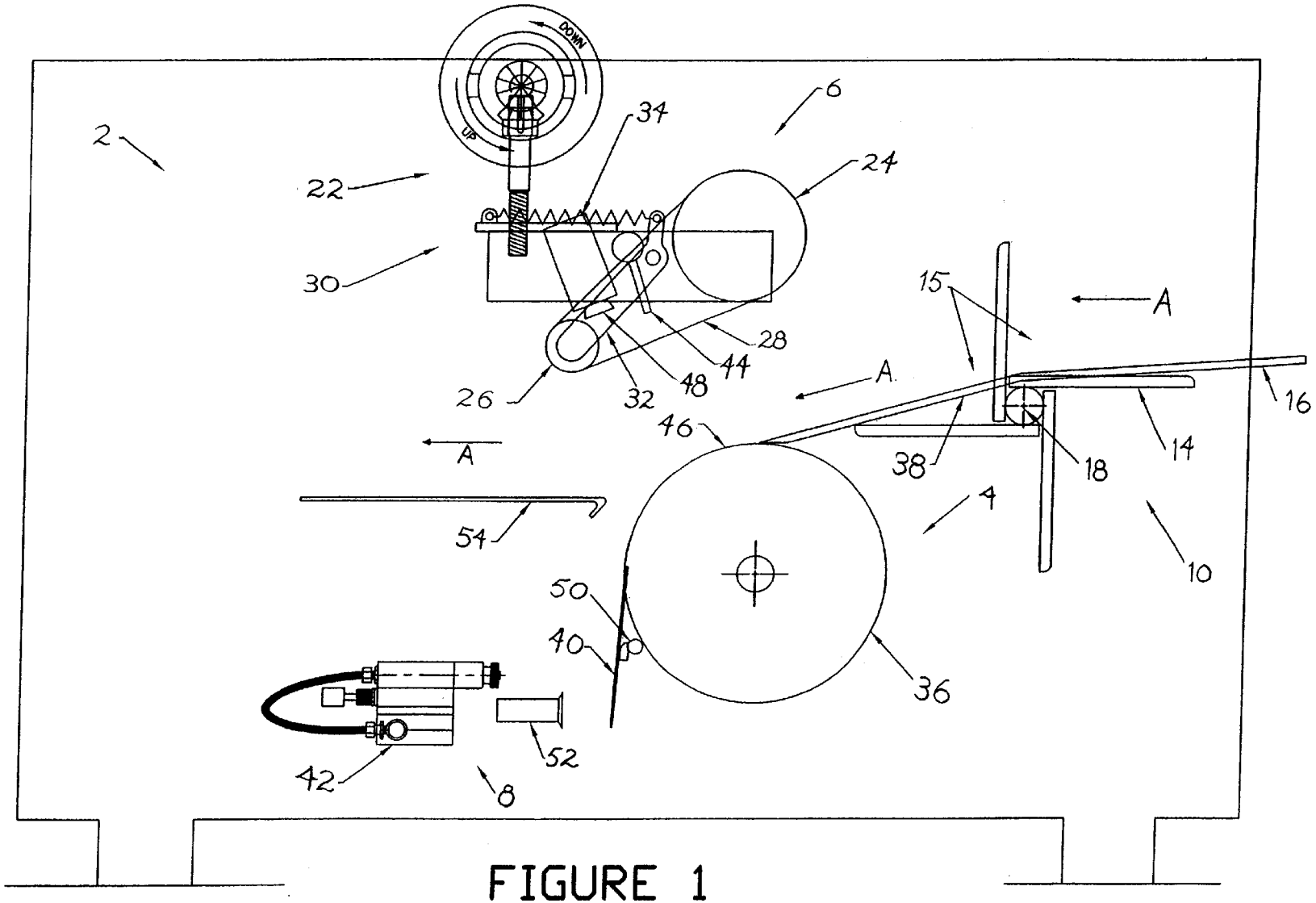
FIG. 1 is an elevational view of the tail sealer apparatus according to a first preferred embodiment of the present invention.

A preferred embodiment of the tail sealer system of the present invention is illustrated in FIG. 1. The path of logs through the tail sealer system 2 is indicated by the arrows A in FIG. 1. The tail sealer system 2 preferably includes three subsystems: a lower conveyor assembly 4, an upper conveyor assembly 6, and an adhesive assembly 8. Preferably, the tail sealer system also includes a rotary indexer assembly 10. Each assembly is discussed below in greater detail.

The rotary indexer assembly 10 is of a type well known in the art, and includes a rotary indexer 14 preferably having four product stations 15 sized to accommodate and hold a log introduced down an intake ramp 16 and into the tail sealer system 2. The rotary indexer 14 is preferably rotatably suspended by an indexer shaft or pivot 18 at the end of the intake ramp 16 which leads logs into the tail sealer system 2. Rotation of the rotary indexer 14 is controlled by a conventional indexer motor or servo motor (not shown) in a manner discussed more fully below.

The term "log" as used herein and in the appended claims denotes a rolled product of any type, such as toilet paper, paper towels, other paper products, fabrics, foils, synthetic sheeting, and any other material which can be wound or rolled about an axis. The term "log" as used herein does not carry with it any inherent or inferred limitation on the final shape or size of the final wound or rolled product.

Preferably, both the lower conveyor assembly 4 and the upper conveyor assembly 6 are adjustably secured in position with respect to one another. In order to accommodate various roll sizes, the upper conveyor assembly 6 is preferably adjustably secured in place by an adjustment assembly 22, which permits the vertical location of the upper conveyor assembly 6 to be changed and set. The adjustment assembly 22 can take a number of forms well-known to those skilled in the art, such as a crank wheel engaging a threaded rod for lifting or lowering a frame attached to the upper conveyor assembly, a hydraulic cylinder connected to an upper conveyor assembly frame or directly to the nip or tension roller 24, 26 (described below) and which can be actuated to raise or lower the upper conveyor assembly 6, etc. Such adjustment assemblies are conventional in nature and are therefore not further described herein. However, it should be noted that the adjustment assembly 22 can be controlled manually or automatically (e.g., via an actuator, solenoid, etc.) in manners which are also well-known in the art. Also, although the embodiment shown in the figures discloses an adjustment assembly adjustable in the vertical direction, it will be appreciated by those skilled in the art that the adjustment assembly 22 can instead be adjustable in the horizontal direction or in both the vertical and horizontal directions in order to change the orientation of the upper conveyor assembly 6 with respect to the lower conveyor assembly 4, the adhesive assembly 8, and/or the ironing roller assembly in alternate embodiments of the present invention.

The upper conveyor assembly 6 preferably includes a roller 24 and a tension roller 26 around which a belt 28 runs. Although the tension roller 26 can be made non-adjustable, the upper conveyor assembly 6 can also be provided with a tensioning mechanism 30 which is used to adjust tension of the belt 28. Specifically, the tension roller 26 is preferably mounted for rotation to a tension arm 32 itself connected to the upper conveyor assembly 6 in a conventional manner (not shown). Preferably, a spring 34 is attached at an end of the tension arm 32 opposite the tension roller 26 and maintains a desired pivoting tension upon the tension arm 32, thereby pushing the tension roller 26 against the belt 28 to maintain a desired tension of the belt 28. The manner in which tension of the spring 34 is adjusted and maintained, and the elements, arrangement, and configuration of the tensioning mechanism 30 are well-known in the art and are therefore not described in greater detail herein. One having ordinary skill in the art will appreciate that a number of other elements and assemblies can be used to maintain a tension force against the tension roller 26 (such as by a coil, leaf, or other spring attached to the upper conveyor assembly 6 and exerting the force upon the tension roller 26, a conventional actuator mounted between the tension roller 26 and the upper conveyor assembly 6, etc.). Such other elements and assemblies and their operation are also well-known to those skilled in the art.

The lower conveyor assembly 4 preferably has a roller 36 rotatably mounted in a conventional fashion at the end of a ramp 38 leading from the rotary indexer assembly 10. The roller 36 is preferably driven by a servo-controlled motor or by any other conventional system capable of rotating the roller 36 in both directions and precisely positioning the roller 36 in various rotational positions. Such conventional drive systems are well-known to those skilled in the art and are not therefore described in greater detail herein.

For purposes which will be described in more detail below, the lower conveyor assembly 4 also preferably has a tail support 40 extending downwardly from the roller 36. The tail support 40 can take a number of forms, such as a plate or series of rigid or substantially rigid members mounted with respect to the roller 36, but preferably is a number of fingers extending downwardly from the surface of the roller 36. When a tail of a log is rotated from the surface of the roller 36 to and across the tail support 40 (see below), a smooth transition from the roller surface to the tail support 40 must be ensured. Accordingly, highly preferred embodiments of the roller 36 have longitudinally-spaced grooves in the roller 36 into which fingers of the tail support 40 extend so that a tail moving from the roller 36 to the tail support 40 does so smoothly.

The adhesive assembly 8 preferably includes a series of sprayers 42 mounted beside the lower conveyor assembly 4 (only one of which is visible in the figures). Most preferably, the series of sprayers 42 extend along substantially the entire length of the lower conveyor assembly 4 and are adapted to spray a line of adhesive upon a log's tail in the adhesive application position as will be described in more detail below. However, the adhesive assembly 8 can instead have as few as one sprayer 42 performing the same operation and spraying a fan of adhesive to deposit the line of adhesive upon the tail. The sprayer(s) 42 can deposit any desired pattern of adhesive upon the tail, including without limitation one or more lines (either arranged in series or in parallel form), dots, or other adhesive patterns. Though not preferred, it is even possible to mount one or more sprayers 42 beside the lower conveyor assembly 4 for longitudinal movement via a track, guide, rail or like element along the lower conveyor assembly. In this manner, adhesive can be sprayed in a line or other pattern across the tail when the tail is in its adhesive application position and/or while the tail is moved to or from the adhesive application position. To ensure a straight longitudinal line of adhesive when the sprayer(s) 42 spray while the tail is moving, the sprayer(s) 42 can be mounted for simultaneous horizontal and vertical movement along the lower conveyor assembly 4 (e.g., the track, guide, rail or like element can be diagonally disposed relative to the lower conveyor assembly 4, can be manually or automatically adjustable relative to the lower conveyor assembly 4, etc.).

Each sprayer 42 is connected in a conventional fashion to a source of adhesive (not shown). The source of adhesive can be a pressurized tank of adhesive or can be a reservoir from which the adhesive is pumped and then pressurized for spraying. The sprayers 42 and their manner of connection to a source of adhesive are conventional in nature and are therefore not described further herein. A number of conventional liquid adhesives exist which are suitable for sealing the tail of a log against the log. Such adhesives are well-known in the art and can be used with any of the tail sealer embodiments disclosed herein.

Operation of the First Preferred Embodiment

With reference to FIGS. 2–10, the operation of the first preferred embodiment of the present invention will now be discussed.

Figure 2:
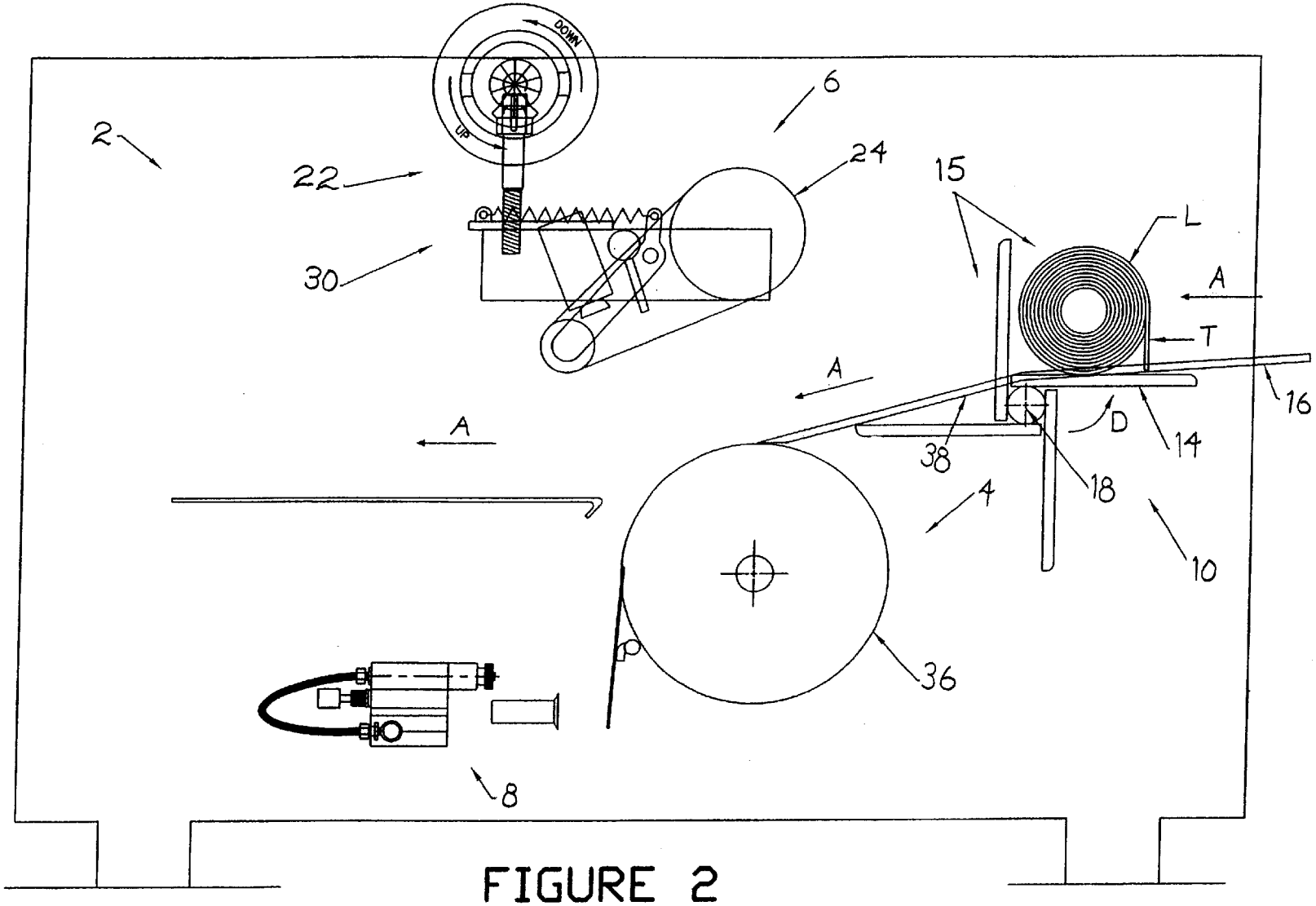
FIG. 2 is an elevation view of the tail sealer of FIG. 1, showing an unsealed log in the rotary indexer.

In FIG. 2, a log L is shown within the rotary indexer 14 of the rotary indexing assembly 10, having rolled down the intake ramp 16 into one of the rotary indexer's four product stations 15. At this stage, the tail T of the log L is not secured to the log L. Next, and at an appropriate time (discussed below) preferably controlled by a motor (not shown) which drives the indexer shaft 18, the rotary indexer 14 is turned about the indexer shaft 18 in a counter-counterclockwise manner indicated by the arrow D in FIG. 2. Eventually, the rotary indexer 14 is turned to such an extent that the log L rolls out of the product station 15 in the rotary indexer 14 and down the ramp 38 to a nip location between the roller 36 of the lower conveyor assembly 4 and the nip roller 24 of the upper conveyor assembly 6 (see FIG. 3).

At this stage, the belt 28 on the upper conveyor assembly 6 is turned by the turning the nip roller 24 in a conventional manner (e.g., by a motor, not shown). If desired, the tension roller 26 can also be driven by the motor or by a dedicated motor mounted in a conventional manner for movement with respect to the adjustable tension roller 26. Similarly at this stage, the roller 36 of the lower conveyor assembly 4 is turned in a conventional manner (e.g., also by a motor, not shown). The turning directions of the belt 28, the nip roller 24, the tension roller 26, and the roller 36 of the lower conveyor assembly 4 are indicated by the arrows E–H in FIG. 3. When the log L is in the nip position shown in FIG. 3, the log L is turned in place while the tail T is freed from the log L (if stuck thereto). Specifically, at this stage, the speed of the belt 28 and the surface speed of the nip roller 24 is equal to the surface speed of the lower conveyor assembly roller 36, thereby causing the log L to rotate in its translational position between the upper conveyor assembly 6 and the lower conveyor assembly 4. While the log L rotates, jets of air are directed from jets 44 toward the surface of the log L. Only one jet 44 is visible in the figures. It should be noted that rather than a series of in-line air jets 44 as preferred in the embodiment of the present invention shown in the figures, one or more blasts of air can be shot from a single jet having a slit-shaped nozzle positioned similarly to the air jets 44. Other conventional air jet shapes and orientations are possible, each achieving the same result of directing a stream or shot of air towards the surface of the log L to release the tail T from the surface of the log L as the log L rotates in the nip position.

Figure 3:
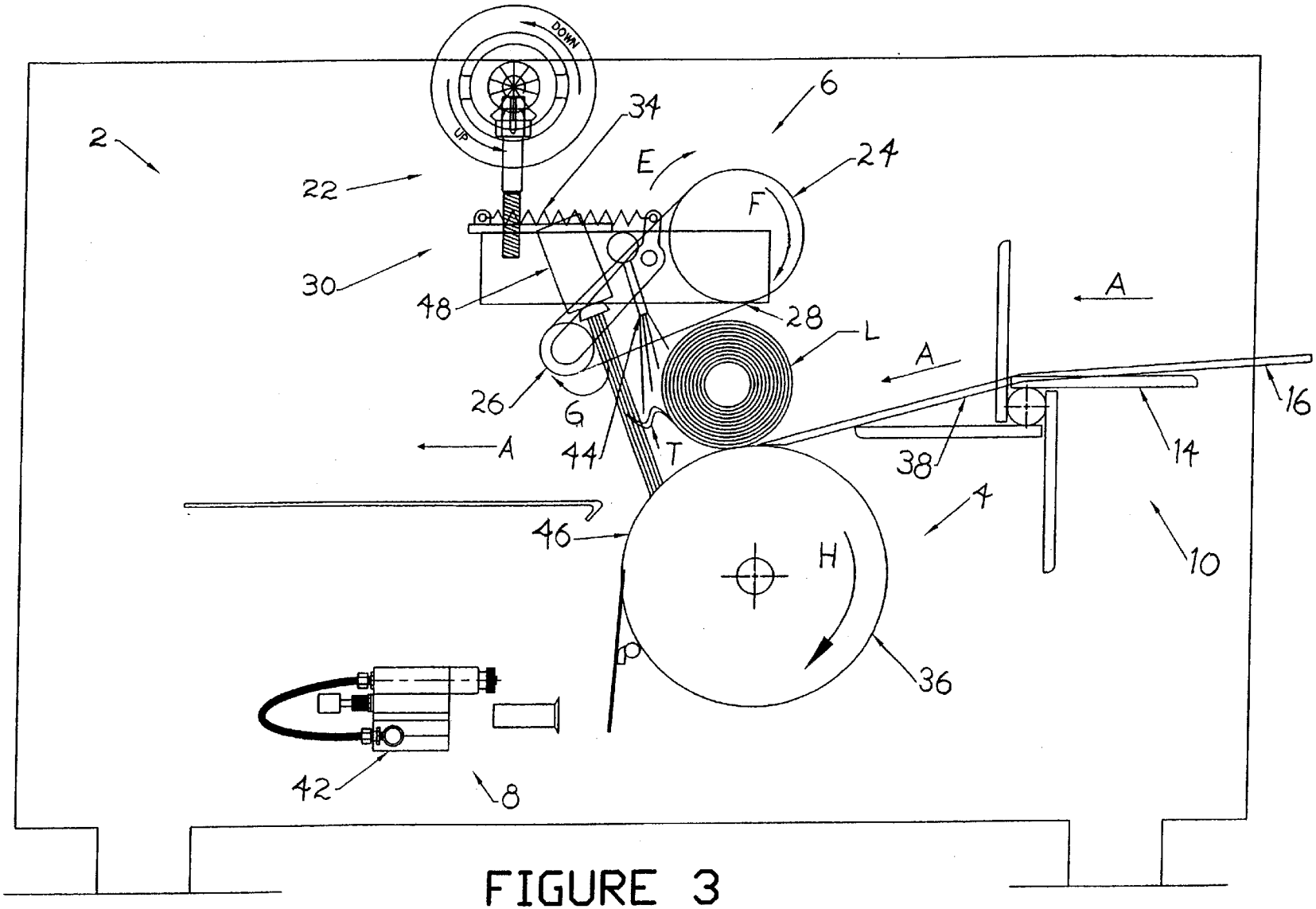
FIG. 3 is an elevational view of the tail sealer of FIGS. 1 and 2, showing the log in the nip position and showing the tail end of the log being blown down into position on a roll of the lower conveyor assembly and in front of the sensor.
Figure 4:
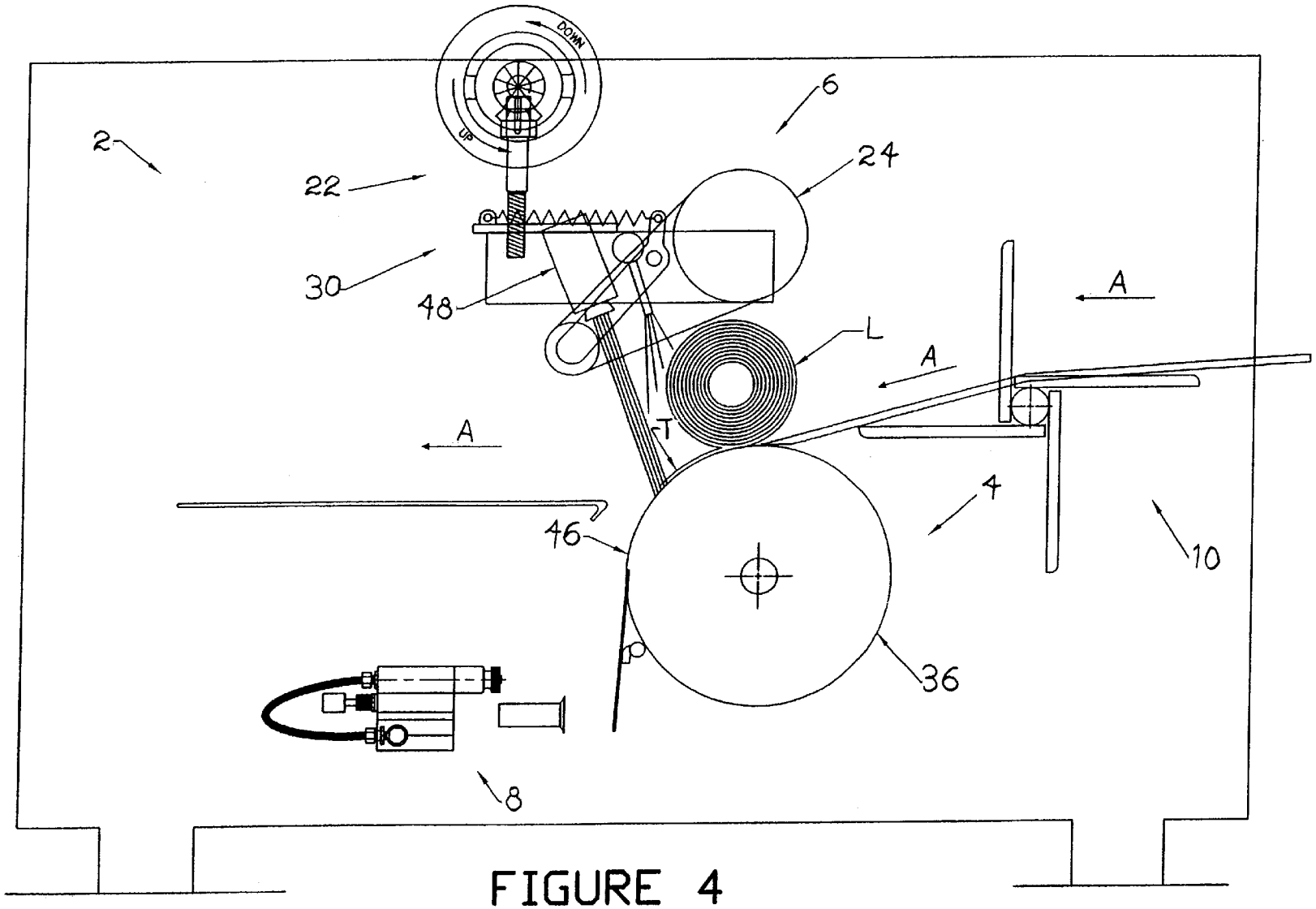
FIG. 4 is an elevational view of the tail sealer of FIGS. 1–3, showing the tail end of the log being drawn by the roll and monitored by the sensor to detect the end of the tail.

Also at the process stage shown in FIG. 3, at least a portion of the surface 46 of lower conveyor assembly roller 36 is continually monitored by a sensor 48 to detect the presence of the tail T and the location of the end of the tail T on the surface 46 of the roller 36. The sensor 48 is preferably mounted on or proximate the upper conveyor assembly 6, and monitors a segment of the roller surface 46 between the point at which the log L contacts the roller 36 and a point on the lower conveyor assembly 4 aligned with the line of fire of the sprayers 42. Although the sensor 48 is preferably an optical sensor, other sensor types can also be used, such as infrared sensors or proximity sensors. Additionally, more than one sensor and sensor type can be used to detect the presence and end of the tail T.

After being blown off of the surface of the log L, the tail T is preferably held in place against the surface 46 of the lower conveyor assembly roller 36 by air emitted from jets 44. It should be noted that additional or different air jets (not shown) can be located around or proximate the upper conveyor assembly 6 to perform this function.

Figure 5:
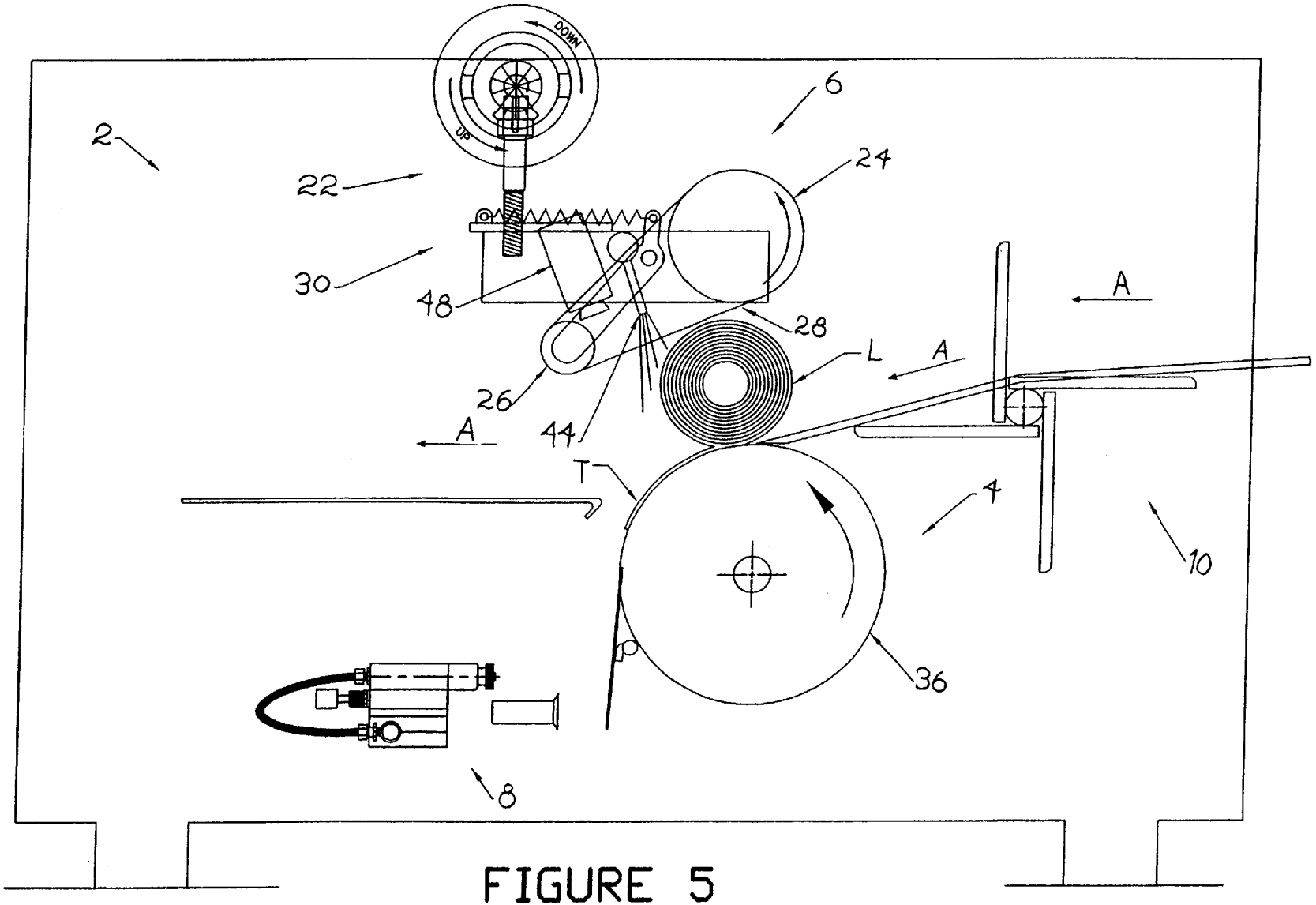
FIG. 5 is an elevational view of the tail sealer of FIGS. 1–4, showing the tail being unwound toward an adhesive applicating position.

The nip roller 24 and the roller 36 of the lower conveyor assembly 4 preferably continue to rotate in a controlled manner by their respective motors until the sensor 48 detects the end of the tail T by detecting the uncovered surface 46 of the roller 36. See FIG. 4. At this point, a signal is sent from the sensor 48 to a conventional controller (not shown) which controls the rotation of the roller 36 and the nip roller 24 via their respective motors. Such controllers and their operation are well-known in the art, and are therefore not described further herein. Once the end of the tail T is detected by the sensor 48, the signal sent to the controller causes the controller to reverse the turning direction of the roller 36 and the nip roller 24 (from turning in clockwise directions to counter-clockwise directions as shown in FIG. 5). It should be noted that the location of the end of the tail T and the location of the log L in the nip position corresponds to angular positions of the lower conveyor assembly roller 36. As such, when the end of the tail T is detected by the sensor 48, the exact length of the tail T is known and certain (the circumferential length of the roll surface 46 between the angular positions just mentioned).

By reversing the rotational direction of the lower conveyor assembly roller 36 as described above, the counter-clockwise rotation of the belt 28 (by the nip roller 24) and the counter-clockwise rotation of the roller 36 causes the tail T to unwind from the log L. As also shown in FIG. 5, air is preferably emitted from the air jets 44 to maintain the tail T upon the roller 36 as the tail T is unwound. The constant air jet force against the tail T as it is unwound from the log L ensures that the tail T unwinds upon the roller 36 in a wrinkle-free manner. Preferably, the speed of the belt 28 and the surface speed of the nip roller 24 is equal to the surface speed of the lower conveyor assembly roller 36, thereby causing the log L to continue rotation in its translational position between the upper conveyor assembly 6 and the lower conveyor assembly 4. However, if movement from the nip position shown in FIG. 5 is desired, such as to move the log L further toward the tension roller 26 as the tail T is unwound, the amount by which the belt 28 moves and/or the amount by which the roller 36 rotates during the counter-clockwise rotation of the roller 36 and the nip roller 24 is preferably measured by the controller. This measurement can be made by conventional devices used to measure the amount of rotation of a motor, drive shaft, or driven unit. Therefore, by the time the tail T of the log L reaches an adhesive application position such as that shown in FIG. 6, the exact length of the tail T is known.

Figure 6:
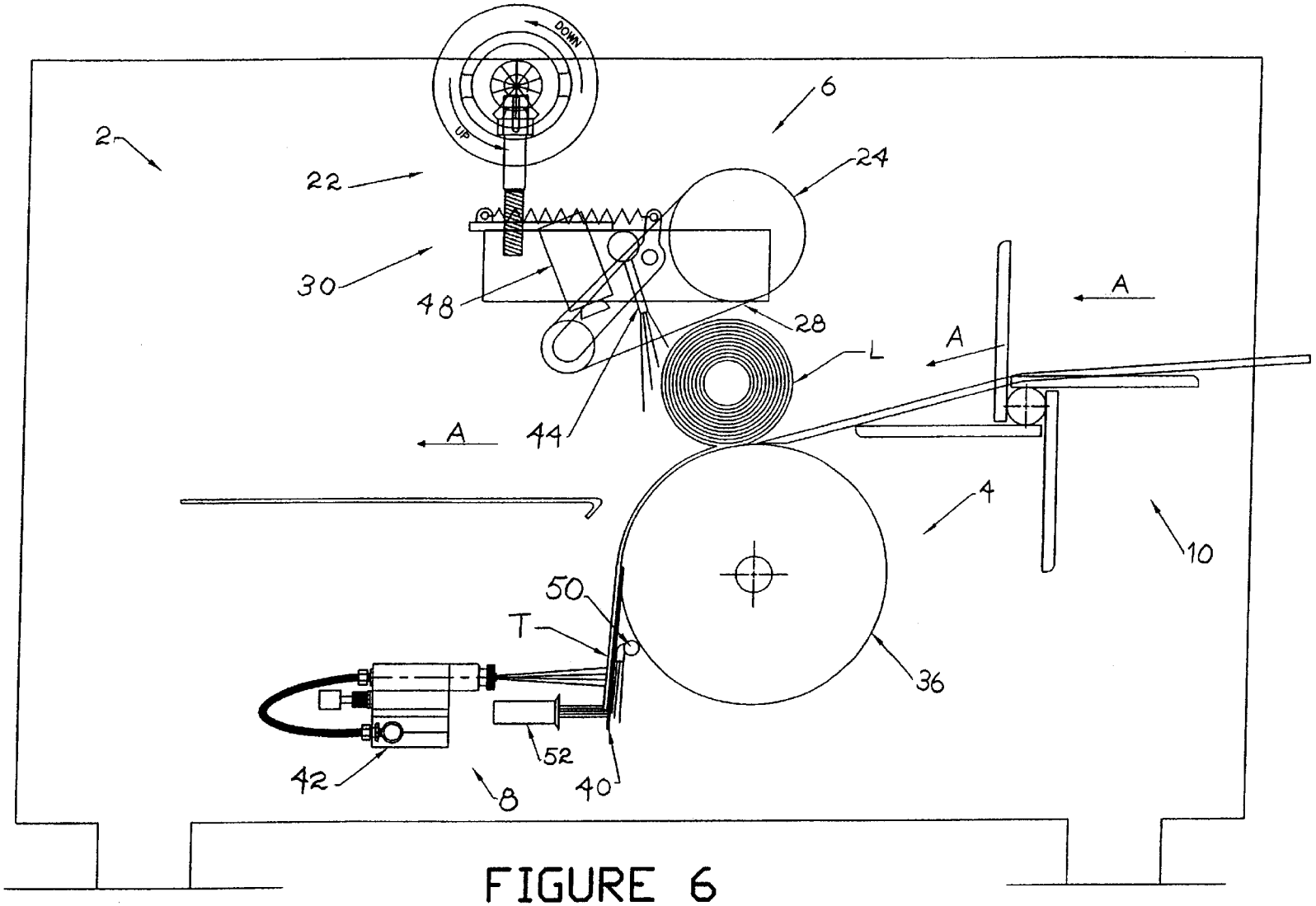
FIG. 6 is an elevational view of the tail sealer of FIGS. 1–5, showing the tail in the adhesive applicating position and the adhesive sprayers spraying adhesive on the tail.

As shown in FIG. 6, the tail is unwound sufficiently to pass over and down the fingers of the tail support 40 until it reaches an adhesive application position. To keep the tail T against the lower conveyor assembly roller 36 and the tail support 40, air continues to be emitted from the air jets 44 upon the tail T. Also, a series of tail support air jets 50 are preferably conventionally mounted beside and are directed downwardly along the tail support 40 in order to help guide the tail T down the tail support 40 and to keep the tail T taut and wrinkle free. Such air jets are conventional in nature and are not therefore described in greater detail herein.

The location of the adhesive upon the tail T is important because it determines how much tail is left free upon the completed product for a consumer to grasp in unwinding a new roll. Too much free tail can lead to problems and jamming in downstream equipment and can detract from the appearance of the finished product. Too little free tail can result in a product which is difficult to unwind. To reliably and consistently apply the adhesive to a desired location on the tail T, an applicator sensor 52 is preferably mounted beside the tail support 40 and positioned to detect the location of the tail T upon the tail support 40. Like the sensor 48 used for detecting the end of the tail T in the tail unwinding stage illustrated in FIG. 4, the applicator sensor 52 is preferably an optical sensor, but other sensor types such as infrared and proximity sensors can also be used. When the applicator sensor 52 detects the end of the tail T, it preferably sends a signal to trigger (either directly or via the system controller) the sprayers 42 to spray adhesive upon the tail T. As such, the location at which the end of the tail T is sensed is preferably a desired distance below the line of sight of the sprayers 42.

One having ordinary skill in the art will appreciate that the distance between the adhesive location and the end of the tail T can be adjusted in several ways. Preferably, multiple applicator sensors 52 are located down the tail support 40, each of which successively detects the presence of the tail T as it proceeds down the tail support 40. By selecting which applicator sensor 52 to trigger the sprayers 42 (via the controller), different distances between the adhesive location and the end of the tail T can be selected. Alternatively, it is possible to mount the applicator sensor 52 for translation alongside the path of the tail T on the tail support 40, such as by a conventional track, rail, or guide assembly, a chain and sprocket or cable and pulley assembly, and the like, each being driven in a conventional manner by a motor or other driving device and controlled manually or by the system controller. By moving the location of the applicator sensor 52 along the tail support 40, the point at which the sprayers 42 are triggered by the applicator sensor can be adjusted to change the distance between the adhesive location on the tail T and the end of the tail T. The location of adhesive upon the tail T can also be changed by moving the location of the adhesive sprayers 42 along the length of the tail support 40. For example, in the embodiment of the present invention shown in the figures, the sprayers 42 can be mounted for vertical movement and can be controlled in much the same manner as the location-adjustable applicator sensors 52 described above.

The location of adhesive upon the tail T can also be changed by measuring the distance between the location of the log L and the end of the tail T. This measurement can be determined by measuring the amount of rotation of the roller 36 and/or the belt 28 to determine how much of the tail T has been unwound off of the log L. Devices capable of automatically measuring roll rotation and belt movement are well-known to those skilled in the art. With this information, the length of the tail unwound is known (the radii of the roller 36 and the nip roller 24 being already set). If desired, these measurement can be transmitted to the system controller for determining the length of the tail unwound. Because the distance between the log L and the line of sight of the sprayers 42 is also known, the length of tail T beyond the line of sight of the sprayers 42 is then found by subtracting the length of the tail T unwound. When the desired length is reached, the sprayers 42 can be triggered manually or by the controller to spray adhesive upon the tail T.

Several other devices and methods exist for changing the location of adhesive sprayed upon the tail T of the log L, each one of which either changes the location of the sprayer (s) or the sensor(s), enables different sensors to trigger the sprayers, monitors the tail length unwound, changes the location of the unwinding log L between the upper conveyor assembly 6 and the lower conveyor assembly 4 (i.e., speeds or slows the lower conveyor assembly roller 36, the nip roller 24, or both rollers), and/or directly measures or senses the length of the tail T unwound. Each of these devices and methods falls within the spirit and scope of the present invention.

Figure 7:
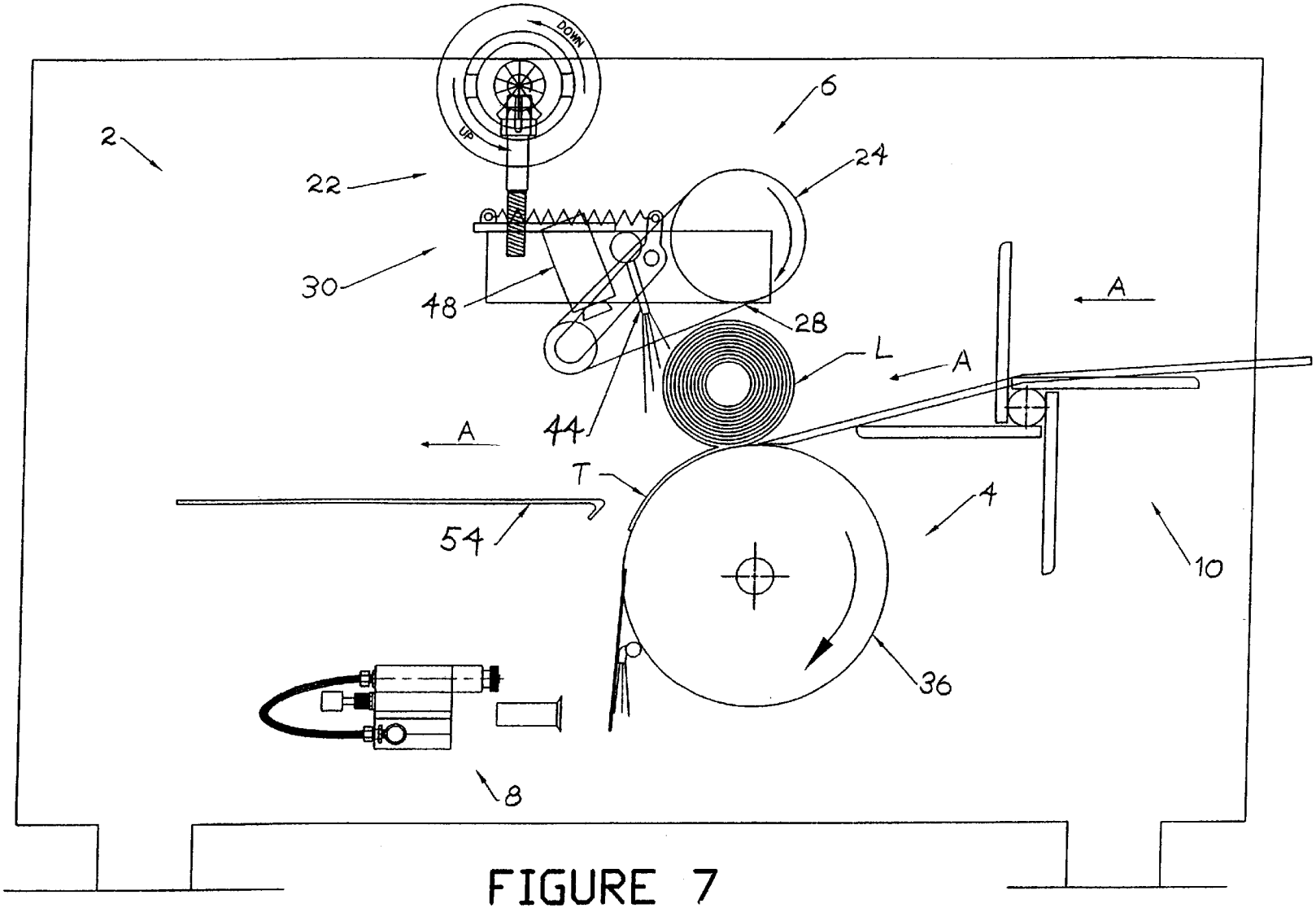
FIG. 7 is an elevational view of the tail sealer of FIGS. 1–6, showing the tail being rewound on the log by reversed rotation of the upper and lower conveyor assemblies.

After adhesive has been sprayed upon the tail T of the log L, the controller causes the drives driving the lower and upper conveyor assemblies 4, 6 to reverse, thereby winding the tail T upon the log L as shown in FIG. 7. Preferably, the lower and upper conveyor assemblies 4, 6 rotate in this manner at the same speed to cause the log L to roll in place as the tail T is wound. Meanwhile, the jets 44 preferably continue to blow jets of air upon the tail T to keep the tail T flat and smooth against the lower conveyor assembly roll 36 and to help prevent wrinkles and creases in the tail T as it is wound upon the log L. Although it is more preferred to fully wind the tail T upon the log L prior to moving the log L from the position shown in FIG. 7 between the lower and upper conveyor assemblies 4, 6, the system controller can operate to slow or even stop the rotation of lower conveyor assembly roller 36 and/or speed the rotation of the belt 28 to move the log L from the nip position while the tail T is still being wound. Therefore, the tail T preferably winds about the log L as the log L is moved to the next operation (discussed below). Such roll speed changes would preferably occur automatically via the controller after an amount of the tail T has been wound upon the log L. In the preferred embodiment, the system controller waits for the tail to fully wind upon the log, at or after which time the system controller changes the speeds of the lower conveyor assembly roller 36 and/or the belt 28 as discussed above to pass the log L out of the nip position of FIGS. 3–7.

As will be discussed more fully below, the location of the tail's end upon the log L is preferably monitored during and after the above processes to determine the rotational orientation of the log L in the tail sealer 2 for downstream log operations. The tail end location can be monitored by measuring rotation of the lower conveyor assembly roller 36 and/or the nip roller 24. After the tail T has been completely rolled upon the log L in the nip position shown in FIGS. 3–7, the end of the tail T can be monitored, for example, by continuing to monitor rotation of the conveyor assembly roller 36 and/or the nip roller 24 with the diameter of the log L being known. The location of the tail end is often important for downstream operations of the sealed log L. For example, it is often desirable to orient the logs L in a downstream accumulator (not shown) with the tail T of each log L in the same rotational position in the accumulator. As another example, when the tail T is ironed upon the log L in a downstream ironing roller assembly, proper ironing is often dependent upon the orientation of the log L in the ironing roller assembly after the log L has been rolled to a position therein. As such, the log L can be rotated to a desired angular orientation before being moved out of the nip position and onto the rolling surface 54.

Figure 8:
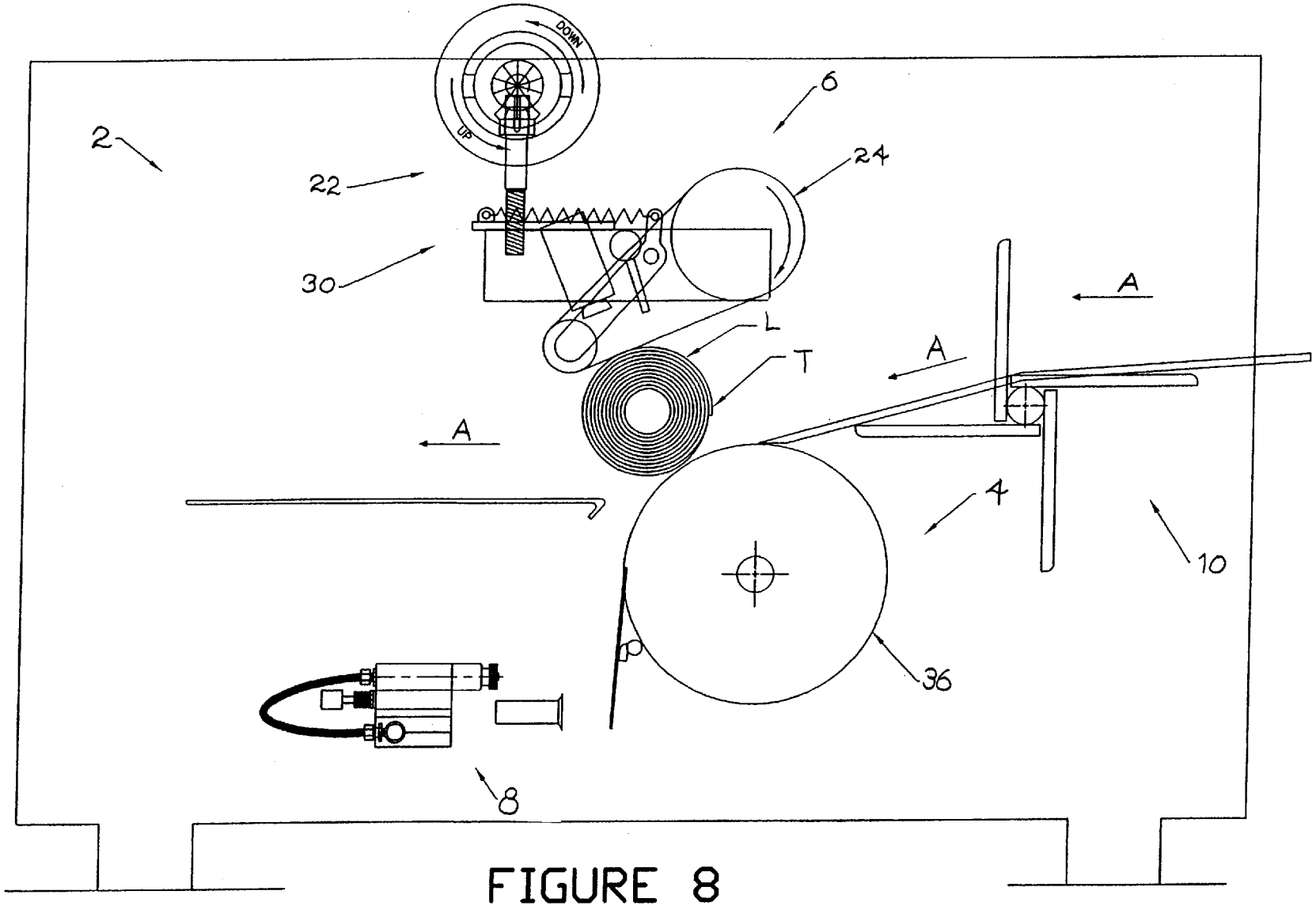
FIG. 8 is an elevational view of the tail sealer of FIGS. 1–7, showing the rewound log being moved from the nip position to the roll surface by stopping the rotation of the lower conveyor assembly.
Figure 9:
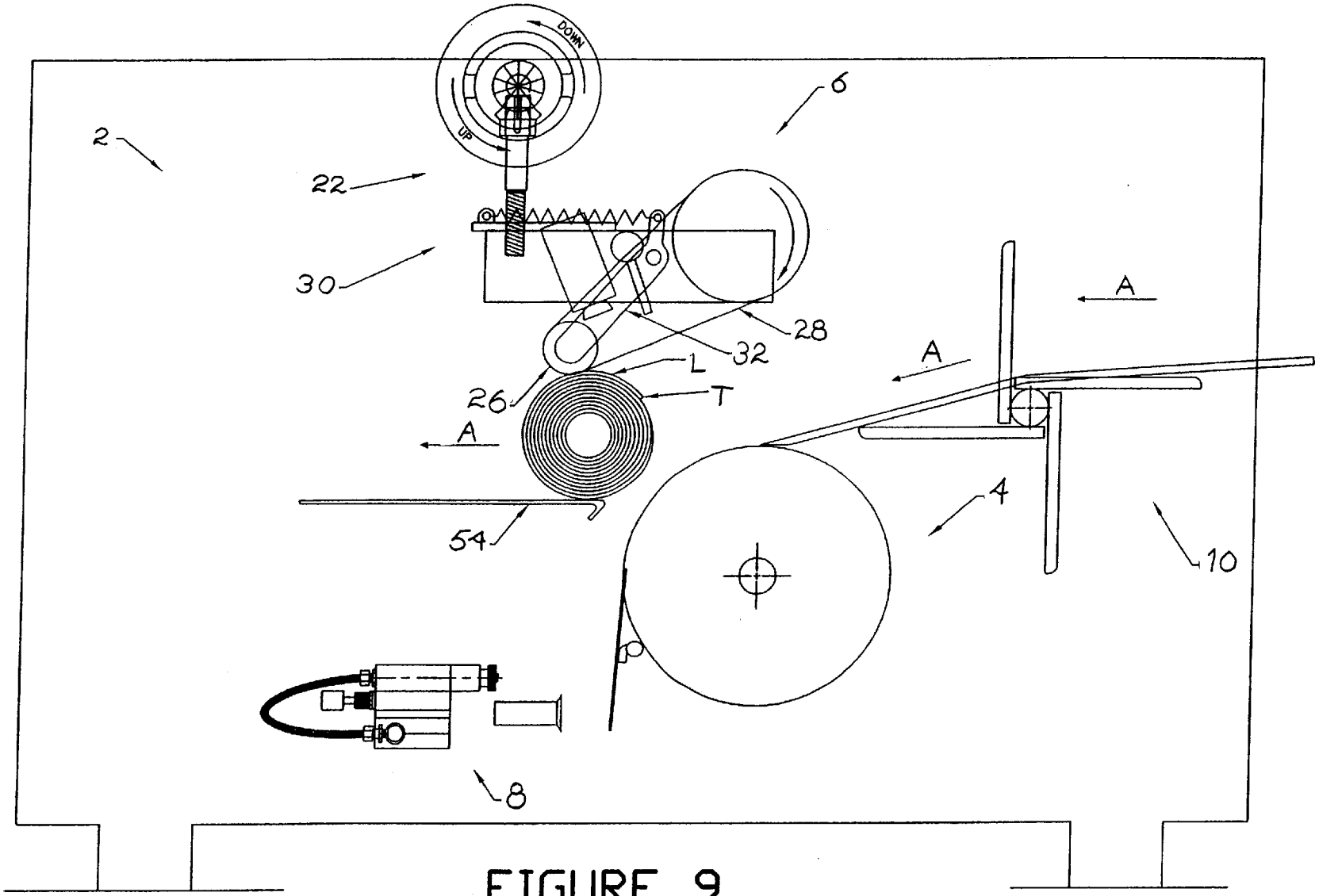
FIG. 9 is an elevational view of the tail sealer of FIGS. 1–8, showing the log leaving the lower conveyor assembly and moving across the roll surface.

With reference now to FIG. 8, the lower conveyor assembly roller 36 is now preferably slowed, stopped, or reversed with respect to the nip roller 24. Alternatively or in addition, the rotational speed of the nip roller 24 can be increased with respect to the lower conveyor assembly roller 36. As can be seen in FIG. 9, the log L is preferably rolled from between the upper conveyor assembly 6 and the lower conveyor assembly 4 to a position on top of a rolling surface 54. The rolling surface 54 preferably extends downstream from the rear of the lower conveyor assembly 4. Preferably, the log L remains between the rolling surface 54 and the belt 28 and/or tension roller 26 of the upper conveyor assembly 6 for rolling the log L along the rolling surface 54. If the tail T has not yet been completely wound upon the log L (as is the case when the log L has been moved from the nip position between the lower and upper conveyor assemblies 4, 6 during tail rewinding), tail rewinding continues as the belt 28 and tension roller 26 rolls the log L along the rolling surface 54. This winding causes the tail T with the adhesive thereon to eventually come into contact with the log L. The tension roller 26 preferably acts to press the tail T and adhesive against the log L to seal the log L. To this end, the spring-biased tension arm 32 preferably creates a pressure upon the passing log L while still permitting the tension roller 26 to ride up and over the log L. However, the tail T can instead be pressed against the log L by rolling upon the rolling surface 54 or by a downstream ironing roller assembly (not shown).

Figure 10:
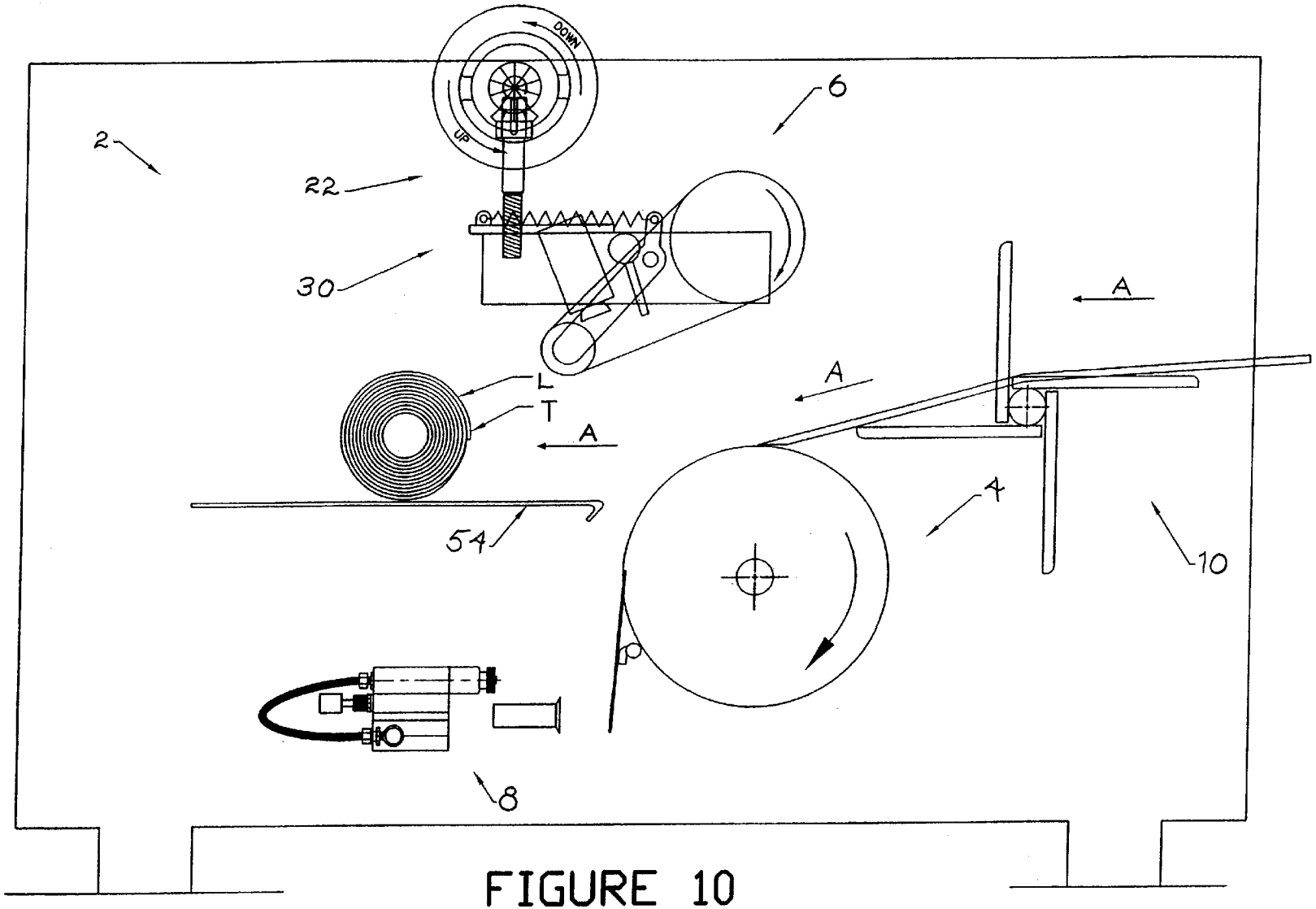
FIG. 10 is an elevational view of the tail sealer of FIGS. 1–9, showing the log rolling out of the tail sealer.

The log L eventually passes from beneath the upper conveyor assembly 6 and continues to roll down the rolling surface 54 to downstream equipment (see FIG. 10). If desired, the rolling surface 54 can be declined away from the lower and upper conveyor assemblies 4, 6 to encourage the logs L to roll away. The rolling surface 54 can also or instead be provided with one or more conventional conveyor belts carrying the logs L away, or a belt can be located above the rolling surface 54 for rolling the logs L across the rolling surface 54.

The Second Preferred Embodiment

Figure 11:
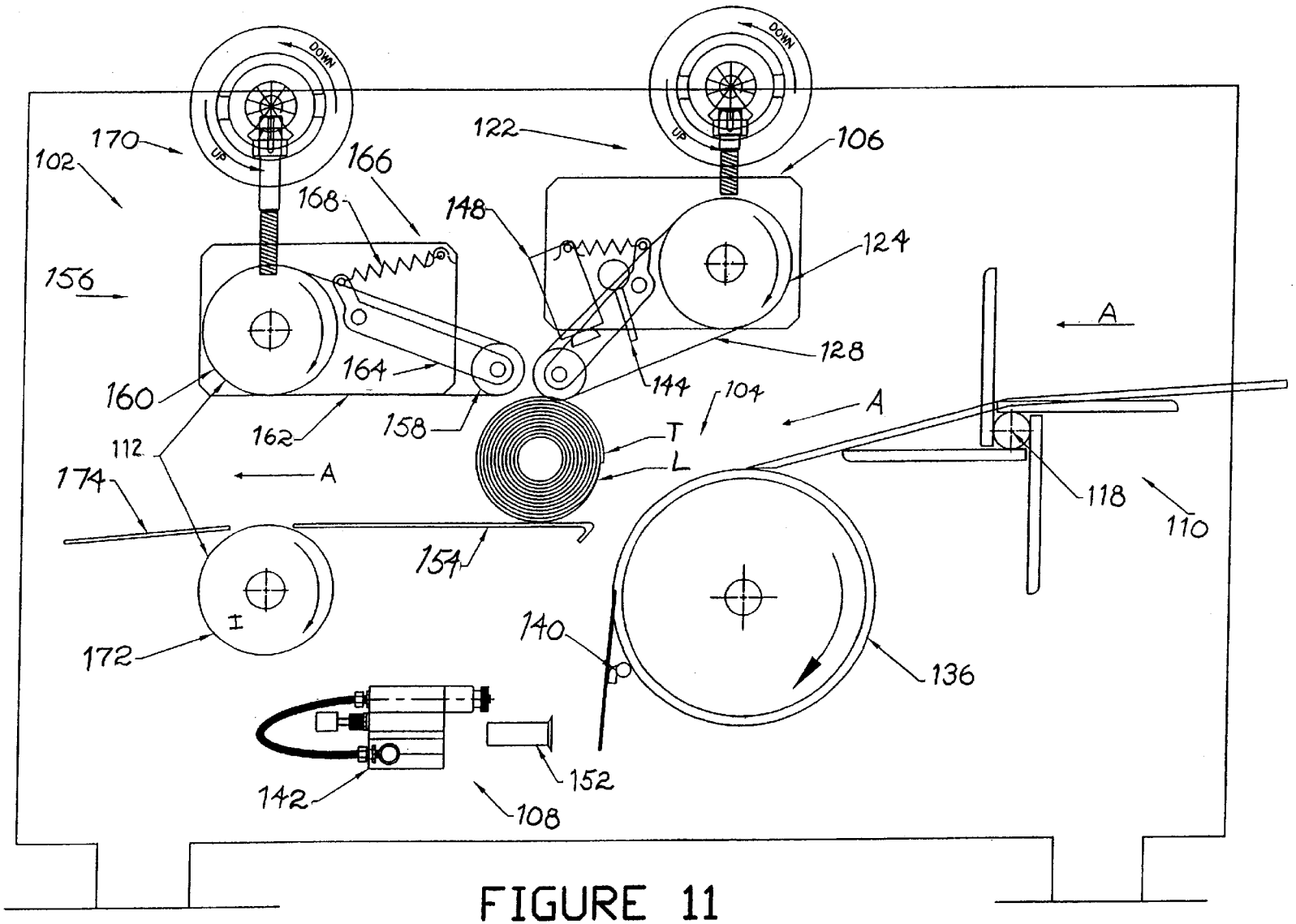
FIG. 11 is an elevational view of the tail sealer apparatus according to a second preferred embodiment of the present invention, showing a log at a tail sealing stage similar to that shown in FIG. 9 of the first preferred embodiment.
Figure 12:
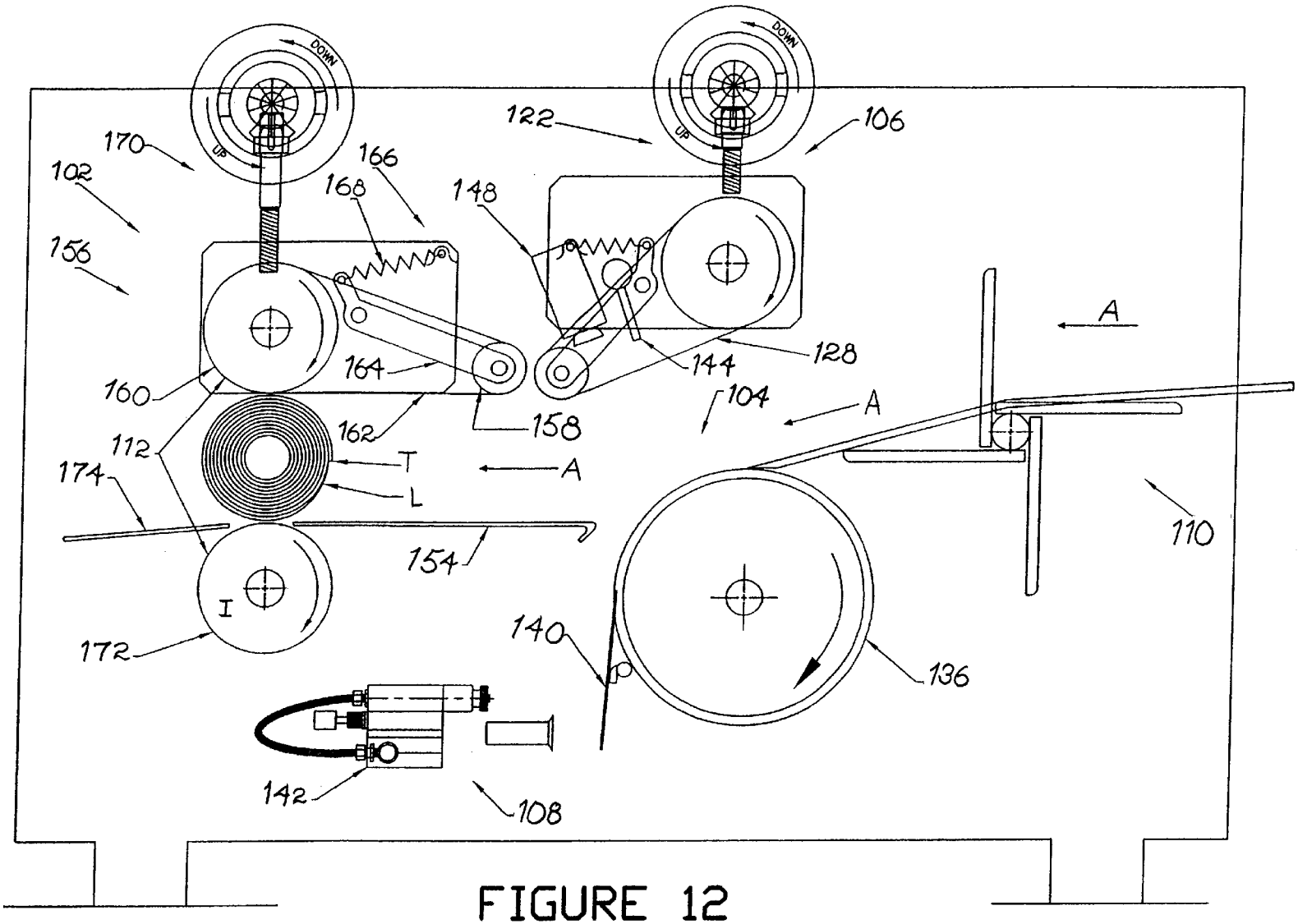
FIG. 12 is an elevational view of the tail sealer of FIG. 11, showing the log in an ironing roll position.
Figure 13:
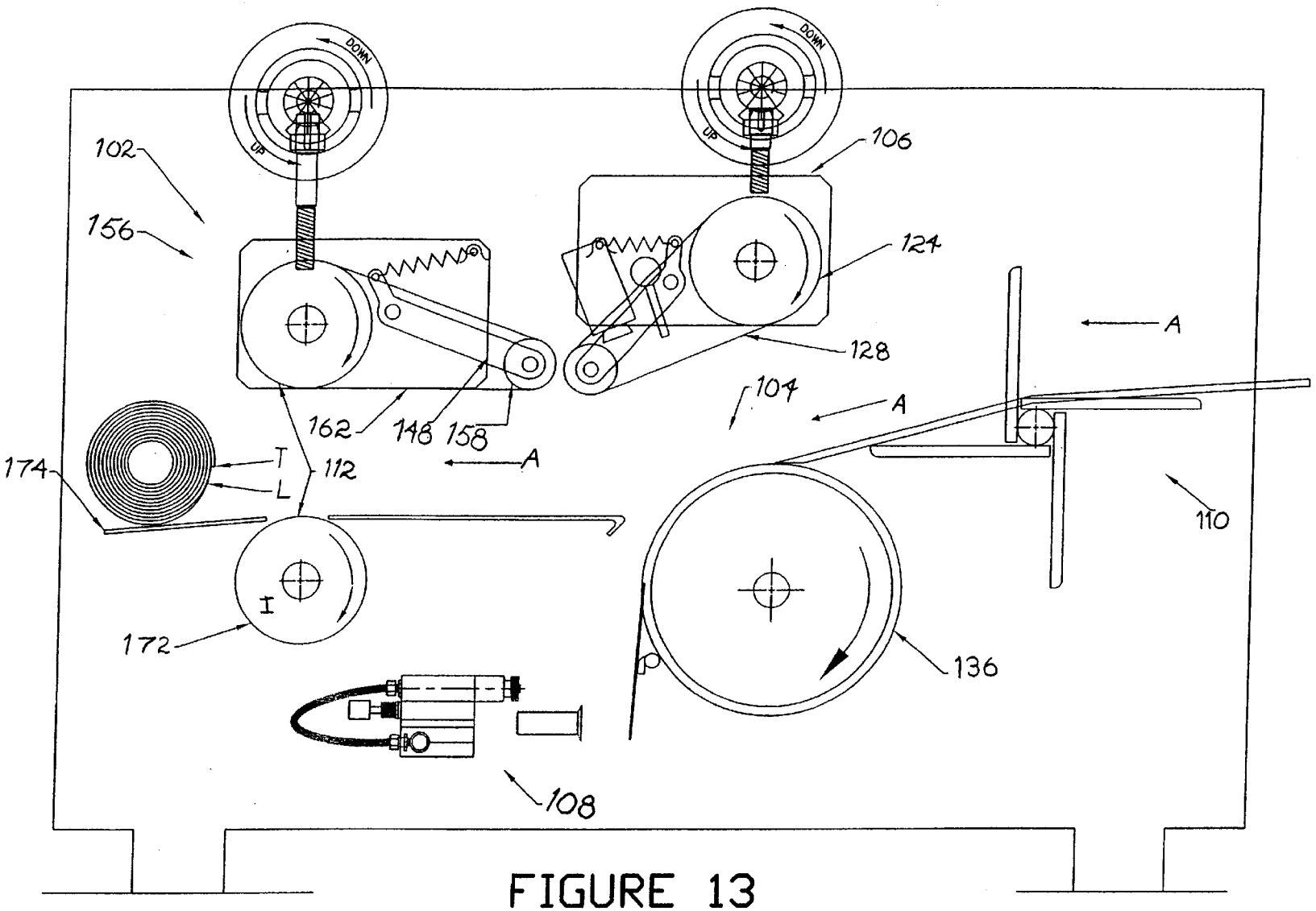
FIG. 13 is an elevational view of the tail sealer of FIGS. 11 and 12, showing the log rolling out of the tail sealer.

A second preferred embodiment of the present invention is illustrated in FIGS. 11–13. The tail sealer system shown in FIGS. 11–13 is substantially the same as that shown in FIGS. 1–10 and described above with respect to the first embodiment, but has additional structure downstream of the upper conveyor assembly 106 for further controlling the logs L and the tail ironing process.

The tail sealer system 102 of the second preferred embodiment has a ironing conveyor assembly 156 preferably located immediately downstream from the upper conveyor assembly 106 and above the rolling surface 154. Preferably, the ironing conveyor assembly 156 is of similar structure and operation as the upper conveyor assembly 106, but is reversed in orientation as can be seen in FIGS. 11–13. The sensor 148 is shown located on the ironing conveyor assembly 156 instead of the upper conveyor assembly 106 to illustrate the various locations the sensor can be placed while still performing its tail end detection functions. Similarly, it should be noted that the jets 144 need not necessarily be attached or otherwise mounted to the upper conveyor assembly 106, and can instead be located on the ironing conveyor assembly 156 and be directed toward the log L and tail T when the log L is in the nip position between the nip roller 124 and the lower conveyor assembly roller 136. Both the sensor 148 and the jets 144 can even be mounted exterior to the upper conveyor assembly 106 and the ironing conveyor assembly 156 (e.g., upon a frame of the tail sealer system 102, a wall thereof, etc.).

Like the upper conveyor assembly 106, the ironing conveyor assembly 156 preferably has a tension roller 158 and a nip roller 160 about which runs an ironing belt 162. The tension roller 158 is preferably mounted for rotation to a tension arm 164 which is itself pivotably mounted under spring force from a tensioning mechanism 166 (e.g., having a spring 168 or other device capable of exerting bias force upon the tension arm 164) in preferably the same or similar manner to the upper conveyor assembly 106. Like the upper conveyor assembly 106, the ironing conveyor assembly 156 can be driven by any conventional motor, engine, or other driving device. Preferably however, the nip roller 160 is driven by a servo-controlled motor which is controlled by the conventional system controller (not shown).

The ironing conveyor assembly 156 runs along the rolling surface 154 to controllably transport the logs L from the upper conveyor assembly 106 as shown in FIG. 11 to an ironing position shown in FIG. 12. Therefore, the ironing conveyor assembly 156 is preferably located above the rolling surface 154 with the ironing belt 162 located a distance sufficient to permit logs L to pass between the ironing belt 162 and the rolling surface 154. This distance is preferably adjustable not only by the movable tension roller 158 under spring force from the tensioning mechanism 166, but also by a conventional adjustment assembly 170. The adjustment assembly 170 for the ironing conveyor assembly 156 is preferably the same as the adjustment assembly 122 for the upper conveyor assembly 106 described above with reference to the first preferred embodiment of the present invention. Both devices preferably permit vertical (and if desired, horizontal) adjustment of their respective conveyor assemblies 156, 106 in a conventional fashion.

The second preferred embodiment of the present invention also preferably has an ironing roll 172 at an ironing position located downstream from the lower and upper conveyor assemblies 104, 106 (see the location of the log L in FIG. 12). The ironing roll 172 is conventional in nature and is preferably mounted for rotation at the end of the rolling surface 154. With continued reference to FIGS. 11 and 12, logs L exiting from between the lower and upper conveyor assemblies 104, 106 are preferably rolled by the ironing belt 162 of the ironing conveyor assembly 156 across the roll surface 154. This motion causes the tail T to come into contact and bond to the surface of the log L via the sprayed adhesive if the tail T has not yet been wound upon the log L by rolling between the lower and upper conveyor assemblies 104, 106. To further secure the tail T to the surface of the log L via the adhesive, the ironing roll 172 presses the tail T against the log L to ensure that the adhesive secures the tail T against the log L. Though not part of the preferred embodiment described herein, the ironing roll 172 can be heated in a conventional manner by a heater assembly (not shown). The heat supplied to the tail T and log L via the heated ironing roll 172 can be used to further assure proper adhesion between the tail T and the log L. Heater systems for hot rollers are well-known in the art and are therefore not discussed in greater detail herein. The use of a hot ironing roll 172 will largely depend upon the type of adhesive used and the need for heat to assist the adhesive in bonding the tail T to the log L.

Preferably, the ironing roll 172 is turned in a conventional manner in a clockwise direction (see the arrow I in FIGS. 11–13) by a motor or other conventional driving device (not shown) at a constant surface speed which is slightly slower than the speed of the ironing belt 162. Therefore, when the ironing belt 162 rolls the log L into contact and over the ironing roll 172, the log L rotates as its translational speed slows significantly. This movement permits the log L to complete one or more rotations over the ironing roll 172 before exiting the ironing conveyor assembly 156. The surface speed of the ironing roll 172 can instead be kept at substantially the same speed of the ironing belt 162 for a period of time sufficient to roll the log L between the ironing belt 162 and the ironing roll 172 for one or more complete rotations, after which time the ironing roll 172 can be slowed or the belt speed can be increased to eject the log L from the ironing position. Alternately, the ironing roll 172 can remain normally stationary and be temporarily turned by its motor only when the log L is rolled thereover. In this alternate configuration, one or more sensors (not shown) can be mounted near the ironing roll 172 to detect the approach of the log L and to send a signal to a controller to turn the ironing roll 172 on for a set period of time or a set number of rotations. Similarly, the sensor(s) can also send a signal to the ironing conveyor assembly 156 which remains normally stationary until the signal is received to thereby begin turning the tension and nip rollers 158, 160 and the ironing belt 162 for the approaching log L. When the ironing roller 172 is intermittently operated in such manner, the ironing roll 172 preferably rotates at a surface speed equal to the speed of the ironing belt 162, thereby keeping the log L in a fixed translational position between the ironing roll 172 and the ironing belt 162 while the log L is being rotated on top of the ironing roll 172.

Other conventional manners exist for turning the ironing roll 172 on only when the log L is rolled thereupon, such as by measuring the amount of belt movement (measuring the rotation of the tension and nip rollers 158, 160, respectively) or by turning on the motor driving the ironing roll 172 at timed intervals corresponding to the frequency of and coinciding with logs L passing across the ironing roll 172. The manners described above for turning the ironing roll 172 only when logs are present or at other particular times are well-known in the art, and therefore are not described in greater detail herein.

After the ironing belt 162 has rolled the log L over the ironing roll 172, the ironing belt 162 preferably rolls the log L to an exit ramp 174, where the sealed log L preferably rolls by gravity out of the tail sealer system 102 as shown in FIG. 13.

As mentioned with respect to the first preferred embodiment above, the exact position of the sealed tail T on each log L is often important to downstream operations. Therefore, tail orientation upon each log L is preferably controlled in the present invention. To accomplish this task, the location of the end of each tail T can be monitored as the logs L pass through the tail sealer system 102. Preferably, this location is measured by the number of rotations of the log L as it passes from the nip position between the lower conveyor assembly roller 136 and the upper conveyor assembly nip roller 124 (where the end of the tail T has been detected by the sensor 148) through the ironing roll position shown in FIG. 12. The number of rotations of the log L through the lower, upper, and ironing conveyor assemblies 104, 106, 156 can be measured by knowing the size of the log L and by measuring the amount of movement or rotation of the lower conveyor assembly roller 136, the upper conveyor assembly belt 128, and the ironing conveyor assembly belt 162. Once the log L reaches the ironing roll 172, the speed of the ironing roll 172 and/or the speed of the ironing belt 162 can be adjusted by the system controller to ensure that the tail T of the log L is positioned at a precise location on the log's circumference when the log L leaves the ironing roll 172. Alternately, the length of the path each log L travels from the lower conveyor assembly roll 136 to the ironing roll 172 can be selected to position the tail T of each log L in a particular orientation when it reaches the ironing roll 172. The speed of the ironing roll 172 and the ironing belt 162 can then be set to rotate the log L through a set number of rotations to eject the log L positioned in a particular orientation. As yet another alternative, the position of the tail T of each log L can even be directly measured in a conventional manner by one or more sensors (not shown) mounted upstream or near the ironing roll 172. The tail end position read by the sensor(s) can then be sent to the system controller which adjusts the speed of the ironing roll 172 and/or the ironing belt 162 to adjust the position of the tail T when the log L is ejected from the ironing position. It will be appreciated that the position of the tail T of a log L can be adjusted in a number of different manners well-known to those skilled in the art and which fall within the spirit and scope of the present invention.

The Third Preferred Embodiment

Figure 14:
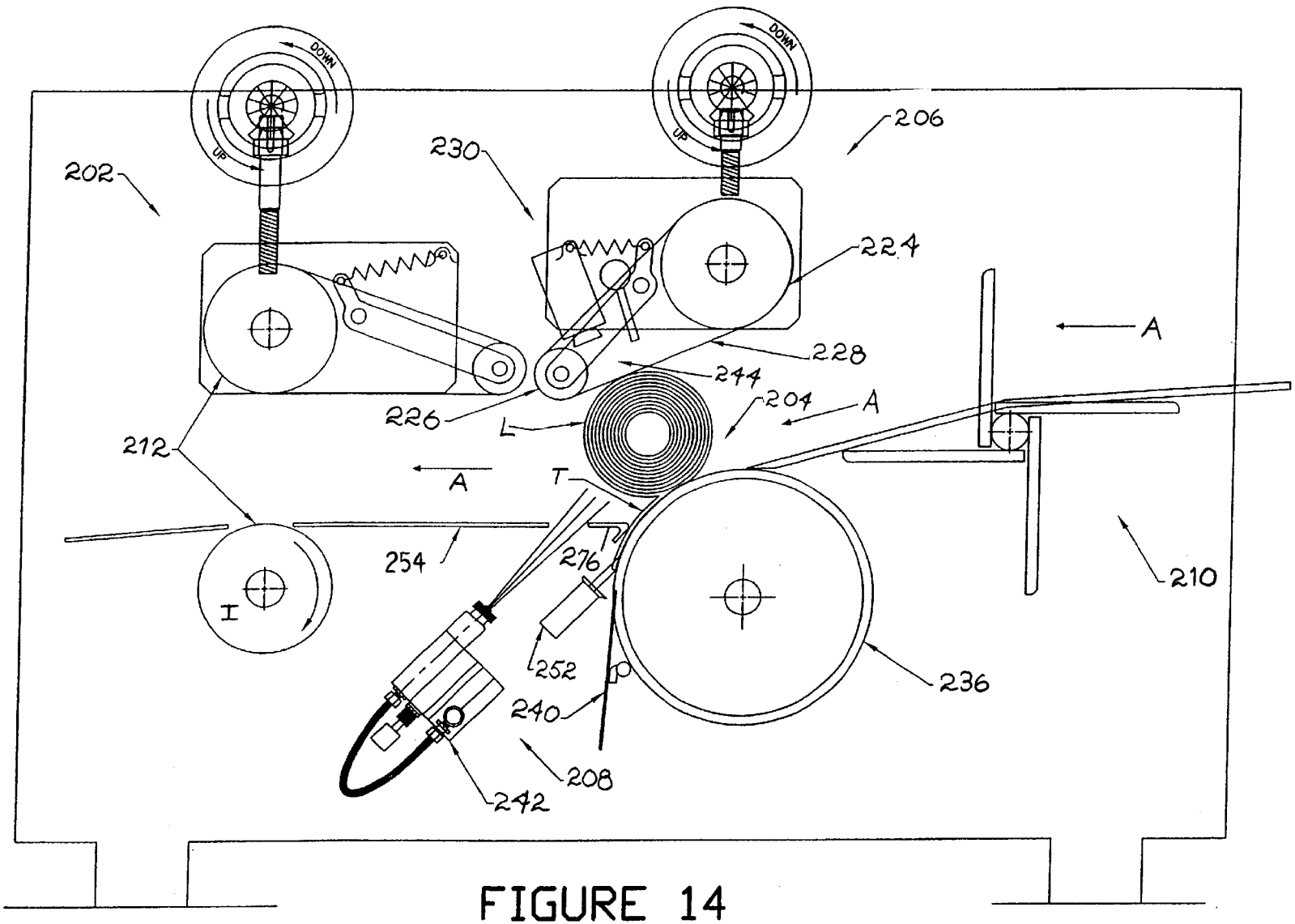
FIG. 14 is an elevational view of the tail sealer apparatus according to a third preferred embodiment of the present invention, showing a log having adhesive sprayed upon the log itself prior to the tail being rewound.
Figure 15:
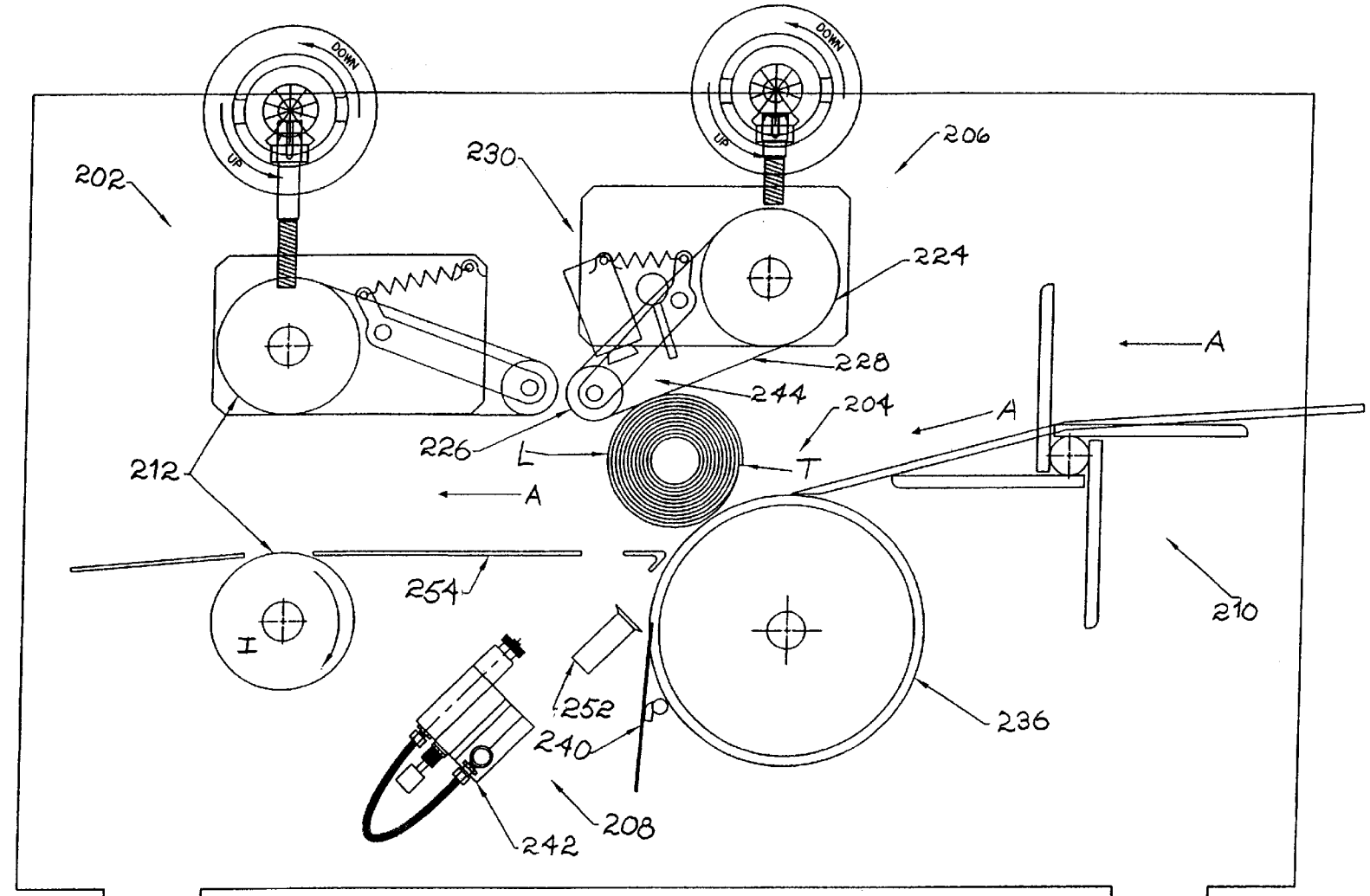
FIG. 15 is an elevational view of the tail sealer of FIG. 14, showing the tail being rewound on the log by reversed rotation of the upper and lower conveyor assemblies.

A third preferred embodiment of the present invention is illustrated in FIGS. 14 and 15. With the exception of the following description, the present invention according to the this third preferred embodiment is substantially the same and operates in substantially the same manner as that disclosed above with reference to the first preferred embodiment of the present invention.

In the tail sealer system 202 of the third preferred embodiment, the adhesive assembly has one or more sprayers 242 directed toward the log L rather than toward the tail T of the log L. Therefore, as the log L moves through the tail sealer system 202, adhesive is applied to the log L and the log L is subsequently rolled to roll the tail T on top of the sprayed area to seal the log L. In order to accomplish this task, the tail sealer system 202 preferably performs the same functions as described above and illustrated in FIGS. 1–4 with reference to the first preferred embodiment of the present invention. While or immediately after the tail T is unwound from the log L, the log L is preferably moved from the nip position (between the lower conveyor assembly roller 236 and the nip roller 224) to the position shown in FIG. 14. Once in this adhesive position, an applicator sensor 252 positioned to detect the presence of the log L preferably sends a signal to the system controller which sends a signal to the adhesive assembly 208 to fire the sprayers 242. After the sprayers 242 have been fired, the belt 228 continues to turn via the nip and tension rollers 224, 226 while the lower conveyor assembly roller 236 is turned in a clockwise direction as viewed in the figures to preferably rotate the log L in place until the tail T is wound upon the log L as shown in FIG. 15. Preferably after the tail T is wound upon the log L (but in other embodiments, while the tail T is being rewound), the system controller causes the lower conveyor assembly roller 236 to stop and/or reverse rotation, thereby causing the log L to be ejected to the rolling surface 254.

It should be noted that the process just described can be performed by the tail sealer system 202 in discreet steps with the log L pausing at the adhesive application position, or can be performed in a continuous motion in which the log L progresses through the system substantially without pausing. Alternatively, the process just described can be altered so that the log L remains in the same position between the nip roller 24 and the lower conveyor assembly roller 26 while the tail T is unwound and rewound upon the log L (as in the first preferred embodiment of the present invention described above). In such a case, the adhesive sprayers 242 would preferably be re-positioned from their locations shown in FIGS. 14 and 15 to spray adhesive upon the log L further upstream of the location shown in FIGS. 14 and 15. Subsequent operations by the tail sealer system 202 are generally the same as that described above with reference to the first preferred embodiment of the present invention.

The length of the tail T unwound from the log L (and therefore, the portion of the log L exposed to the sprayers 242) is directly dependent upon the difference in speed between the belt 228 and the lower conveyor assembly roller 236 and the amount of tail length unwound while the log L is in the nip position between the lower conveyor assembly roller 236 and the nip roller 224. Fast movement of the belt 228 relative to the lower conveyor assembly roller 236 will result in a shorter tail T, while slower relative movement will result in a longer tail T. The speeds of the belt 228 and the lower conveyor assembly roller 236 can be controlled in a manner as described above with reference to the first preferred embodiment of the present invention.

In order to provide additional support to the log L in the adhesive application position shown in FIG. 14 (depending upon the spacing between the lower conveyor assembly roller 236 and the rolling surface 254), the tail sealer system 202 can be provided with a log support 276 mounted in a conventional manner between the lower conveyor assembly roller 236 and the rolling surface 254. The log support 276 is preferably sufficiently long or has portions which are spaced sufficiently to support the log L temporarily while adhesive is sprayed upon the log L. It should be noted that rather than employ an applicator sensor 252 as described above, the presence of the log L in the adhesive application position can be triggered by a number of other devices well-known to those skilled in the art. For example, the log support 276 can have a pressure sensing device (not shown) connected thereto in a conventional manner and capable of detecting pressure or weight of the log L upon the log support 276. The pressure sensing device can be a pressure switch, pressure plate, a weight scale or other conventional device capable of detecting differences in pressure or weight. When the presence of the log L is thereby detected, the pressure sensing device triggers the sprayers 242 in the same manner as the applicator sensor 252 described above. As another example, a trip switch or other like device can be located upon the log support 276, on the edge of the rolling surface 254, etc. to trip when the log L moves to the adhesive application position.

It should be noted that the applicator sensor 252 need not be directed upwardly as illustrated in FIGS. 14 and 15. Instead, the applicator sensor 252 can be position in a manner similar to that shown in FIGS. 1–13 to detect the presence of the tail end upon or beside the lower conveyor assembly roll 236. For example, the log L can be rolled to unwind the tail T from the log L before the log L reaches the adhesive application position shown in FIGS. 14 and 15. When the end of the tail T reaches the line of sight of the applicator sensor 252 directed toward the lower conveyor assembly roll 236, the applicator sensor 252 can send a signal to adjust the speed of the roller 236 and/or the nip roller 224 to move the log L into the adhesive application position. Tail length adjustment can therefore be performed in much the same manner as that described above and also with reference to the first preferred embodiment of the present invention.

In each embodiment of the system just described, rolls of wound product L are quickly passed through a series of stations which index the logs L, free the tails for later manipulation, consistently create desired tail lengths and adhesive locations without tail wrinkling, and securely bond the tails T to the logs L. Each embodiment performs these functions with a streamlined system having much fewer parts, components, and assemblies than conventional tail sealer systems and methods, thereby significantly lowering system cost and maintenance.

The embodiments disclosed above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

For example, although only one log L is shown in the figures as being present in the tail sealer system 2, 102, 202, at one time, multiple logs L can certainly be accommodated within the tail sealer systems 2, 102, 202, each log L being located at different stages in the tail sealing process (represented, for example, by each of FIGS. 2–10 in the first preferred embodiment). In one example of such operation, a first log L can be introduced into the tail sealer system 2, 102, 202 as shown in FIG. 2. Upon reaching the tail sealing stage shown in FIG. 4, another log L can be introduced into the system by being rolled into the rotary indexer 14. Therefore, as the first log L proceeds through the remaining tail sealing steps represented by FIGS. 5–10, the second log L follows three steps behind the first log L. Further logs can similarly be introduced in series at three step intervals. With multiple logs passing through the tail sealer system 2, 102, 202 simultaneously, the product output of the tail sealer system 2, 102, 202 increases significantly without the addition of more elements or assemblies.

As another example of the various changes possible to the tail sealer systems 2, 102, 202 described above which fall within the scope of the present invention, it will be noted that alternatives to the particular rotary indexer assembly 4, 104, 204 disclosed in the embodiments are possible. One having ordinary skill in the art will appreciate that a number of other devices well-known in the art for feeding rolled products in a controlled manner would work equally well to index logs L into the tail sealer systems 2, 102, 202. Tail sealer systems 2, 102, 202 employing such other indexing devices fall within the spirit and scope of the present invention.

Although a roll such as that described above and illustrated in the figures is preferred for the lower conveyor assembly 4, 104, 204, it is possible to replace the lower conveyor assembly roller 36, 136, 236 with a number of alternative devices and assemblies capable of performing the same functions as the lower conveyor assembly roller 36, 136, 236. In each preferred embodiment and in each alternative embodiment of the lower conveyor assembly 4, 104, 204, a surface is provided which is preferably movable to roll the log L in place in the system, to move the log L while the log L is rolled, or to perform both functions as in the preferred embodiments above. Also in each preferred embodiment and in each alternative embodiment of the lower conveyor assembly 4, 104, 204, the movable surface acts to wind, unwind, or to both wind and unwind the tail T of the log L. In alternative embodiments of the present invention, the lower conveyor assembly roller 36, 136, 236 can be replaced by one or more belts running around pulleys or sprockets driven in by a motor or other conventional driving device. As used above and in the appended claims, the term "roller" (i.e., a device capable of rolling logs L) therefore not only includes an elongated member having a round cross-section such as that shown in the figures, but also includes a belt or like assembly as just described. In such case, the tail support 40 can extend from the surface of the endless belt(s) in much the same manner as it does in from the surface of the lower conveyor assembly roller 36, 136, 236 of the preferred embodiments. It is even possible to eliminate the tail support 40, 140, 240 altogether by replacing the tail support 40, 140, 240 with a stretch of the endless belt(s) which support the tail T of each log L during the adhesive spraying process. Although not preferred, the tail support 40, 140, 240 can also be removed from any of the preferred embodiments of the present invention. In such case, it is preferable to locate the adhesive assembly 8, 108, 208 and/or the applicator sensor 52, 152, 252 so that the spray location upon the tail T is at a point on the lower conveyor assembly roller 36, 136, 236 where the tail T is supported to some degree by the lower conveyor assembly roller 36, 136, 236.

Another alternative to the lower conveyor assembly roller 36, 136, 236 disclosed in the preferred embodiments is a vacuum roll or vacuum belts. Specifically, the lower conveyor assembly roller 36, 136, 236 can be a conventional vacuum roll within which a vacuum is created by connecting the vacuum roll to a vacuum source. Vacuum connections (such as rotary vacuum valves and rotary unions) for connecting vacuum rolls to a source of vacuum are well known to those skilled in the art and are therefore not described further herein. Examples of such vacuum systems and vacuum rolls are disclosed in, for example, U.S. Pat. No. 4,494,741 issued to Fischer et al. and U.S. Pat. No. 4,917,665 issued to Couturier, the teachings of which are incorporated herein by reference insofar as they relate to vacuum rolls and vacuum connections to such rolls. As with most conventional vacuum rolls, the surface of the vacuum roll can have a number of apertures therethrough to create a suction on the surface for holding the tail against the surface. Vacuum can be continuously ported to the lower conveyor assembly roller for continuous suction on the lower conveyor assembly roller. Alternatively, vacuum can be controllably ported to the lower conveyor assembly roller by a system controller operable in a conventional manner.

For increased vacuum roll efficiency, vacuum is preferably ported via the rotary vacuum valves and rotary unions to the vacuum roll only in that portion of the vacuum roll where suction is needed to manipulate the log tails T (e.g., in the upper left-hand quadrant of the roll 36, 136, 236 illustrated in the figures). Such vacuum rolls are also well-known to those skilled in the art, and are not therefore described therein.

As mentioned above, the lower conveyor assembly roller 36, 136, 236 can be replaced by one or more vacuum belts, each of which has a vacuum box or enclosure over or past which the vacuum belts pass. Like the vacuum roll described above, the vacuum belts preferably have a number of apertures therethrough to create a suction on the surface of the vacuum belt for holding the log tails thereto. Also as with the vacuum roll, the vacuum box or apertures are preferably only located in those areas of the belt paths in which vacuum is needed for control of the log tails. Systems for controlling the application of vacuum to vacuum belts and vacuum rolls (and thereby to control the log tails thereon) are well-known to those skilled in the art and are therefore not disclosed further herein.

Yet another alternative to the lower conveyor assembly roller 36, 136, 236 employed in the preferred embodiments of the present invention is a roller, belt, or belts such as those just described, but which employ electrostatic force rather than vacuum and suction force to controllably retain log tails T to the roller, belts, or belts. Specifically, a conventional electrostatic generator can be mounted in a conventional manner beneath or beside the roller 36, 136, 236, belt or belts to generate an electrostatic field upon the outer surface of the roller 36, 136, 236, belt or belts at times controlled by the system controller when it is desired to hold the tail T of a log thereagainst (e.g., in the process steps represented by FIGS. 2–9 of the first preferred embodiment). Such electrostatic generators, their manner of connection, and their operation are well-known to those skilled in the art and are therefore not described further herein.

Systems employing either a vacuum or an electrostatic roller 36, 136, 236, belt or belts as described above offer increased tail control and better design flexibility for the adhesive assembly 8, 108, 208 and the tail support 40, 140, 240. Because the log tails T can now be positioned as desired upon the roller 36, 136, 236, belt or belts (even unwound to a position beneath the lower conveyor assembly while being held thereto), the adhesive assembly 8, 108, 208 can be located almost anywhere in front of, behind, or beneath the roller 36, 136, 236, belt, or belts, and can have the sprayers 42, 142, 242 directed as desired. Because the log tails T can be held against the lower conveyor assembly 4, 104, 204, tail rewinding operations such as those illustrated in FIGS. 7–9 of the first preferred embodiment can be performed with less chance of wrinkling and folding. As the log L is rewound and exits the nip position illustrated in FIGS. 4–7, the tail T can be gradually "peeled" off of the roller 36, 136, 236, belt, or belts to keep the tail T taut and wrinkle-free during rewinding. Also, adhesive can be applied to the tail T while it is held against the lower conveyor assembly roller 36, 136, 236, belt, or belts rather than employing a tail support 40, 140, 240. Alternatively, vacuum or electrostatic force can be generated in well-known manners upon only desired portions of the roller 36, 136, 236, belt or belts (e.g., to the upper left-hand quadrant of the roller 36, 136, 236 shown in the figures) to release log tails T to a tail support 40, 140, 240 for the adhesive application step.

Although not preferred, it should be noted that the lower conveyor assembly roller 36, 136, 236 and the alternative lower conveyor assembly surfaces discussed above need not actually move. Specifically, the lower conveyor assembly 4, 104, 204 can be one or more stationary surfaces which only act to convey the logs L by channeling the logs L from the nip position through to the rolling surface 54, 154, 254. In such case, the logs L preferably roll by movement of the upper conveyor assembly nip roller 24, 124, 224, belt 28, 128, 228, tension roller 26, 126, 226, or combination thereof. While this arrangement affords limited ability of the logs L to roll in place between the lower and upper conveyor assemblies 4, 104, 204, 6, 106, 206, logs L which are rolled into the nip position with a precise tail orientation (i.e., detected via conventional tail location devices, sensors, and the like upstream of the nip roller 24, 124, 224 or upstream of the rotary indexer assembly 10, 110, 210) can have their tails T blown down upon the surface by the jets 44, 144, 244. Because the location of the tails T are thereby known prior to entering the nip position, the location of the tails T upon the surface and the tail support 40, 140, 240 are also known. Therefore, the adhesive assembly 8, 108, 208 can be positioned beside the tail support 40, 140, 240 to direct adhesive spray at a desired location upon the tail T when in its location. After or during adhesive application, the upper conveyor assembly 4, 104, 204 can be operated to roll each log L toward the rolling surface 54, 154, 254, thereby causing the tail T to be wound upon the log L. In this alternative embodiment of the present invention, the tail T is not unwound in the manner of the preferred embodiments, but is instead blown off the log L directly upon the surface of the lower conveyor assembly roller 36, 136, 236 and the tail support 40, 140, 240 in the position in which adhesive is to be applied. Although the ability to adjust tail lengths is more restricted, such a system design is simpler and easier to control and operate.

Each of the preferred embodiments disclosed above and illustrated in the figures employs an upper conveyor assembly 6, 106, 206 having a nip roller 24, 124, 224, a tensioning mechanism 30, 130, 230 (with a tension roller 26, 126, 226), and a belt 28, 128, 228. However, it should be noted that a the preferred conveyor assembly 6, 106, 206 can be replaced by a number of different elements and mechanisms capable of performing the same or similar functions as the disclosed upper conveyor assembly 6, 106, 206. For example, the upper conveyor assembly 6, 106, 206 need not have a tension roller 26, 126, 226 or even a tensioning mechanism 30, 130, 230. The upper conveyor assembly 6, 106, 206 can be just an upper nip roller whose vertical and/or horizontal position is adjustable as described in the preferred embodiments above via an adjustment assembly. In such case, logs L following the operational steps described above are preferably wound fully before being ejected from the nip position.

As another example, the upper conveyor assembly 6, 106, 206 can be replaced by a surface (e.g., a plate or series of plates, one or more rods running above and along the lower conveyor assembly, and the like), in which case logs L are rolled through the nip position by the lower conveyor assembly with the upper conveyor assembly helping to control and funnel movement of the logs L through the apparatus. The surface is preferably movable toward and away from the lower conveyor assembly 4, 104, 106 in much the same manner as the upper conveyor assemblies 6, 106, 206 of the preferred embodiments described above, and can include portions which are shaped to accommodate logs L in various positions from the nip position to the rolling surface 54, 154, 254. For example, the surface could be a plate pivotable about a pivot point above the rolling surface 54, 154, 254 and having an inverted U-shaped portion at approximately the same position as the nip roller 24, 124, 224 in the preferred embodiments above. The plate would be pivotable to swing the U-shaped portion toward and away from a log L in the nip position to retain the log L there while the tail T of the log T is blown off the log L, unwound, sprayed with adhesive, and then rewound. Other plates, surfaces, and plate or surface shapes are also possible to maintain the log L in a particular location upon the lower conveyor assembly 4, 104, 204 while winding, adhesive applicating, and rewinding operations are performed, all of which fall within the spirit and scope of the present invention.

Therefore, the upper conveyor assembly of the present invention need not have rollers or belts. The upper conveyor assembly need not be anything more than a surface movable with respect to the lower conveyor assembly to funnel logs L through the apparatus and preferably also to retain the logs L in one or more positions by virtue of the upper surface's shape and position with respect to the lower conveyor assembly.

It should be noted that several adhesives used to secure the tail T to the log L can be employed with satisfactory results. Although some of such adhesives bond more securely if subjected to heat (for example, from an ironing roll 172 supplying heat), many adhesives bond adequately without the need for heating. Therefore, when such adhesives are used, the ironing roll 172 shown in the second preferred embodiment of the present invention need not be heated, thereby saving system cost and system maintenance cost. Whether or not hot ironing rolls 172 are used, any number of ironing rolls 172 can be employed (rather than just one as shown in the figures). Also, where heat is desired to be applied to the tails T and logs L, the application of heat to the logs L need not necessarily be through hot rolls. Instead, other surfaces (such as a heated flat surface) can be used in place of a hot roll, with the logs L being pressed against the hot surfaces as they move through and/or out of the tail sealer system 2, 102, 202. The tail sealer systems 2, 102, 202 disclosed above and illustrated in the figures which employ such other methods to complete the sealing of logs L also fall within the spirit and scope of the present invention. Also, it should be noted that the motors driving the indexer shaft 18, 118, 218, the nip rollers 24, 124, 224, 160, the tension rollers 26, 126, 226, 158, the lower conveyor assembly roll 36, 136, 236, and the ironing roll 172 can be of a number of different types and sizes well-known to those skilled in the art. The aforementioned motors can be of a type either providing feedback to closed loops (sending information regarding motor torque, velocity, and/or position to a controller) or not providing feedback. Motors providing feedback can be servo motors or otherwise, with the feedback being used to control the operation of the elements driven by the respective motors. The various types of motors which can be used in the present invention are well-known to those skilled in the art, and are therefore not described in greater detail herein.

Although the preferred embodiments of the present invention employ sprayers 42 in the adhesive assemblies 8, 108, 208, one having ordinary skill in the art will appreciate that a number of alternative devices can be used to apply a line or pattern of adhesive upon log tails in the adhesive application positions described above. For example, the adhesive assembly 8, 108, 208 can have an adhesive applicator roll mounted for rotation to continuously bring adhesive from an adhesive reservoir to the tail. The adhesive applicator roll can be mounted for axially reciprocating movement toward and away from the tail in a manner well-known to those skilled in the art, thereby transferring adhesive to the tail in each reciprocation of the adhesive applicator roll. This roll can dip into a tank of adhesive during each reciprocation, or come into contact with one or more other rolls rolling in the adhesive. Alternatively, the tail support 40, 140, 240 can be mounted for pivotal rotation about its upper end and can be rotated in a conventional manner to bring the tail T to the adhesive application roll in order to apply the adhesive to the tail T. In another alternative embodiment, the adhesive assembly 8 has a dip arm pivotable from a position in which the end of the dip arm is immersed in an adhesive reservoir to a position in which the end is brought into contact with the tail T or log L. The system controller can control the speed and position of the arm to synchronize the arm movements with the regular frequency of tails T and logs L entering the adhesive application position or to trigger movement of the arm when the location of the log L or tail end is measured and determined to be in the adhesive application position as described in the preferred embodiments above. Alternatively, the conventional driver or actuator pivoting the arm can be triggered by one or more sensors detecting the presence or approach of tails T or logs L into the adhesive application position.

Having thus described the invention, what is claimed is:

1. A tail sealing apparatus for sealing a log tail to a log, the tail sealing apparatus, comprising:

a first surface;

a tail support extending away from the first surface, wherein the first surface is movable with respect to the tail support;

a second surface disposed a distance from the first surface and defining a log path at least a portion of the distance therebetween;

an adhesive applicator located adjacent to the tail support and configured and arranged to apply adhesive toward the tail support; and an applicator sensor positioned to monitor the tail in at least one location along the tail support, the applicator sensor coupled to the adhesive applicator to trigger the adhesive applicator upon detection of a tail at a location along the tail support.

2. The tail sealing apparatus as claimed in claim 1, wherein the first surface is defined at least in part by a roller mounted for rotation.

3. The tail sealing apparatus as claimed in claim 2, further comprising a sensor positioned to detect tail presence upon the roller for triggering roller reversal to unwind the tail on the roller.

4. The tail sealing apparatus as claimed in claim 1, further comprising at least one jet positioned to blow the tail off of the log and upon the first surface.

5. The tail sealing apparatus as claimed in claim 1, further comprising at least one tail support jet directed at least partially along the tail support for maintaining tail position across the tail support.

6. A method of sealing a log tail to a log, the method comprising the steps of:

rolling the log to a position upon a roller;

blowing the tail upon the roller;

rotating the roller to roll the log thereupon and to unwind the tail on the roller to an adhesive application position;

applying adhesive to at least a portion of the tail in the adhesive application position;

reversing rotation of the roller to wind the tail upon the log; and rolling the log away from the roller.

7. The method as claimed in claim 6, further comprising the steps of:

rotating the roller to roll the log thereupon;

detecting an end of the tail upon the roller; and reversing rotation of the roller;

prior to the step of unwinding the tail on the roller.

8. The method as claimed in claim 7, wherein the position upon the roller is a nip position between the roller and a surface located a distance from the roller, and wherein the step of rotating the roller to roll the log includes rolling the log between the roller and the conveyor assembly.

9. The method as claimed in claim 8, wherein the log remains in the nip position during the step of unwinding the tail.

10. The method as claimed in claim 6, further comprising the step of blowing fluid upon the tail during the step of unwinding the tail.

11. The method as claimed in claim 6, further comprising the steps of:

sensing the location of the tail in the adhesive application position; and sending a signal to apply adhesive to the tail.

12. The method as claimed in claim 6, wherein the adhesive application position is a position along a tail support adjacent the roller.

13. The method as claimed in claim 6, wherein the adhesive application position is a position upon the roller.

14. The method as claimed in claim 6, wherein the log remains in the position upon the roller for at least a portion of the step of winding the tail upon the log.

15. The method as claimed in claim 6, wherein the log moves from the position upon the roller after the step of applying adhesive to the tail.

16. The method as claimed in claim 6, further including the step of rolling the log between an ironing conveyor assembly and a rolling surface.

17. The method as claimed in claim 16, further comprising the step of rolling the log between the ironing conveyor assembly and the ironing roller to seal the tail upon the log.

18. A tail sealer apparatus for sealing a tail of a log to the log, the tail sealer comprising:

a roller mounted for rotation and upon which the log is rollable, the roller rotatable from a first position in which the tail is unwound by the roller a first length from the log to a second position in which the tail is unwound by the roller a second length from the log, the first length being shorter than the second length;

a sensor positioned to detect tail position in at least one location; and an adhesive assembly located adjacent the roller and coupled to the sensor, the adhesive assembly configured and arranged to apply fluid to the tail when the roller is in the second position determined by sensor detection of the tail in the second position.

19. The tail sealer apparatus as claimed in claim 18, wherein the adhesive assembly has at least one adhesive sprayer.

20. The tail sealer apparatus as claimed in claim 19, wherein the at least one adhesive sprayer is positioned to spray adhesive upon the tail when the roller is in the second position.

21. The tail sealer apparatus as claimed in claim 18, further comprising a tail support extending away from the roller, the adhesive assembly and the tail support being located on opposite sides of the tail when the roller is in the second position.

22. The tail sealer apparatus as claimed in claim 21, wherein the adhesive assembly has at least one adhesive sprayer directed toward the tail support.

23. The tail sealer apparatus as claimed in claim 18, further comprising an upper conveyor assembly located a distance from the roller and defining a log nip position between the upper conveyor assembly and the roller.

24. The tail sealer apparatus as claimed in claim 18, further comprising at least one fluid jet positioned to blow the tail off of the log and upon the roller.

25. The tail sealer apparatus as claimed in claim 18, further comprising an ironing conveyor assembly and an ironing roll located downstream of the roller, the ironing conveyor assembly and the ironing roll defining a nip position therebetween in which the log rotates and is sealed.

26. A method of sealing a log tail to a log, the method comprising the steps of:

rolling the log upon a roller to unwind the tail from the log;

passing the tail from the roller to a tail support adjacent to the roller;

applying adhesive to the tail when the tail reaches a desired length along the tail support;

reversing rotation of the roller to wind the tail upon the log; and rolling the log off of the roller to seal the tail upon the log.

27. The method as claimed in claim 26, further comprising the step of blowing the tail upon the roller prior to rolling the log upon the roller to unwind the tail from the log.

28. The method as claimed in claim 27, further comprising the step of reversing rotation of the roller after blowing the tail upon the roller and before the step of unwinding the tail from the log.

29. The method as claimed in claim 28, wherein the step of reversing rotation of the roller is initialized by detection of an end of the tail upon the roller by a sensor.

30. The method as claimed in claim 26, wherein adhesive is applied to the tail via at least one adhesive sprayer coupled to a sensor, the sensor triggering the adhesive sprayer to spray adhesive upon the tail when the sensor detects the tail at a desired location along the tail support.

31. The method as claimed in claim 26, further comprising the steps of:

rolling the log to an ironing roll position; and rolling the log upon the ironing roll the tail to the log.

* * * * *